US010928746B2

(12) United States Patent
Aruga et al.

(10) Patent No.: US 10,928,746 B2
(45) Date of Patent: Feb. 23, 2021

(54) IMAGE FORMING APPARATUS INCLUDING OPTICAL PRINT HEAD

(71) Applicant: CANON KABUSHIKI KAISHA, Tokyo (JP)

(72) Inventors: Daisuke Aruga, Abiko (JP); Hitoshi Iwai, Abiko (JP); Shinichiro Hosoi, Tokyo (JP); Toshiki Momoka, Tokyo (JP); Takehiro Ishidate, Tokyo (JP); Yuya Tamura, Tsukuba (JP); Shinichiro Kaikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 16/170,464

(22) Filed: Oct. 25, 2018

(65) Prior Publication Data

US 2019/0129327 A1 May 2, 2019

(30) Foreign Application Priority Data

Oct. 27, 2017 (JP) ..... JP2017-208427
Sep. 12, 2018 (JP) ..... JP2018-170836

(51) Int. Cl.

| | |
|---|---|
| ***G03G 15/00*** | (2006.01) |
| ***B41J 2/45*** | (2006.01) |
| ***G03G 15/04*** | (2006.01) |
| ***G03G 21/16*** | (2006.01) |

(52) U.S. Cl.
CPC ..... *G03G 15/04054* (2013.01); *G03G 15/80* (2013.01); *G03G 21/1633* (2013.01); *G03G 21/1666* (2013.01); *G03G 2215/0409* (2013.01)

(58) Field of Classification Search
CPC ..... G03G 15/04054; G03G 15/04045; G03G 15/80; B41J 2/385; B41J 2/45
See application file for complete search history.

(56) References Cited

U.S. PATENT DOCUMENTS 6,338,550 B1 * 1/2002 Amano ..... B41J 2/14233 347/71
9,304,477 B2 4/2016 Sone
(Continued)

FOREIGN PATENT DOCUMENTS

JP 2015-205497 A 11/2015

OTHER PUBLICATIONS

U.S. Appl. No. 16/166,511, Shinichiro Hosoi Hitoshi Iwai Yuya Tamura Takehiro Ishidate Toshiki Momoka Daisuke Aruga, filed Oct. 22, 2018.

(Continued)

*Primary Examiner* — Scott A Richmond
(74) *Attorney, Agent, or Firm* — Venable LLP

(57) ABSTRACT

An image forming apparatus includes a drum unit, an optical print head, a moving mechanism, a moving mechanism supporting member, a main assembly, a flexible flat cable, a first cover portion made of a resin material and provided in the supporting member so as to cover a first portion of a cutting plane of the opening, the first portion opposing one surface of the flexible flat cable, and a second cover portion made of a resin material and provided in the supporting member so as to cover a second portion of the cutting plane of the opening, the second portion opposing the other surface of the flexible flat cable.

8 Claims, 16 Drawing Sheets

(56) References Cited

U.S. PATENT DOCUMENTS

| | | | | |
|---|---|---|---|---|
| 2006/0107721 | A1* | 5/2006 | Oishi | B21D 28/26 72/327 |
| 2010/0245480 | A1* | 9/2010 | Suzuki | B41J 2/155 347/50 |
| 2011/0265539 | A1* | 11/2011 | Lu | B21D 31/043 72/325 |
| 2015/0309468 | A1* | 10/2015 | Sone | G03G 15/80 347/118 |

OTHER PUBLICATIONS

U.S. Appl. No. 16/166,530, Toshiki Momoka Daisuke Aruga Hitoshi Iwai Shinichiro Hosoi Takehiro Ishidate Yuya Tamura, filed Oct. 22, 2018.

* cited by examiner (a)

(b)

(a)

(b)

(a)

(b)

IMAGE FORMING APPARATUS INCLUDING OPTICAL PRINT HEAD

FIELD OF THE INVENTION AND RELATED ART

The present invention relates to an image forming apparatus including an optical print head to which a flexible flat cable (FFC) for transmitting a driving signal from a controller is mounted.

In image forming apparatuses such as a printer and a copying machine, there is an image forming apparatus provided with a plurality of light emitting elements for exposing a photosensitive drum to light. The optical print head includes an LED (light emitting diode), an organic EL (electro-luminescence) device or the like as an example of a light emitting element (device), and an optical print head in which the light emitting elements are arranged along a rotational axis direction of the photosensitive drum in a row (line) or in a plurality (two) of rows (lines) with a staggered pattern has been known. Further, the optical print head includes a plurality of lenses for focusing light beams, emitted from the plurality of light emitting elements, onto the photosensitive drum. The plurality of lenses are disposed opposed to the surface of the photosensitive drum so as to extend along an arrangement direction of the light emitting elements between the light emitting elements and the photosensitive drum.

The photosensitive drum is one of consumables, and therefore is exchanged periodically. For that reason, a drum unit including the photosensitive drum is constituted so as to be mountable to and dismountable from an image forming apparatus main assembly. An operator such as a user or service person can perform maintenance of the image forming apparatus by exchanging the drum unit with a new exchange unit by extracting the exchange unit from the apparatus main assembly and then inserting the new exchange unit into the apparatus main assembly. During exchange of the exchange unit, in order to prevent contact of, for example, the photosensitive drum to the optical print head, the photosensitive drum and the optical print head are spaced from each other with a certain distance (spaced position). On the other hand, during image formation, the optical print head contacts the drum unit and is positioned at the photosensitive drum (contact position). Accordingly, in general, an image forming apparatus including a moving mechanism for moving the optical print head between the spaced position and the contact position has been known.

Incidentally, the plurality of light emitting elements provided on the optical print head emit the light beams depending on driving signals from the controller. The driving signals from the controller are transmitted to the optical print head through a cable. Japanese Laid-Open Patent Application (JP-A) 2015-205497 discloses a structure of a periphery of a cable mounted to an optical print head.

An exposure unit 52 disclosed in JP-A 2015-205497 includes an exposure portion 521 and a supporting bar 522 formed with a metal plate. The exposure portion 521 includes a substrate on which a plurality of light emitting elements such as LEDs are provided and includes lenses for focusing light beams from the light emitting elements. In order to transmit driving signals from a controller, provided in an apparatus main assembly, to an optical print head, to the substrate of the exposure portion 521, a cable (flexible flat cable) 502 is connected. As shown in FIG. 2 of JP-A 2015-205497, the cable 502 is connected to the substrate through a hole **522*h* provided in the supporting bar 522. In general, a hole, such as the hole 522*h***, provided in the metal plate is formed by shearing.

However, the hole **522*h* of the exposure unit 52** disclosed in JP-A 2015-205497 causes the following problem.

In the case where the exposure portion 521 is moved between an exchanging position and an exposure position by the moving mechanism as described above, the cable 502 also moves together with the moving exposure portion 521. At that time, there is a liability that the cable 502 contacts and slides with a cutting plane (cutting surface) of the hole **522*h*** and is thus damaged.

SUMMARY OF THE INVENTION

According to an aspect of the present invention, there is provided an image forming apparatus comprising: a drum unit including a photosensitive drum rotatable relative to a main assembly; an optical print head including a light emitting element configured to emit light to which the photosensitive drum is exposed; a moving mechanism configured to reciprocate the optical print head between a contact position where the optical print head is contacted to the drum unit and a spaced position where the optical print head is spaced from the drum unit; a supporting member fixed to the main assembly and configured to support the moving mechanism, wherein the supporting member is made of metal and is provided with an opening formed by shearing; a main assembly substrate fixed to the main assembly; a flexible flat cable provided so as to pass through the opening and connecting the main assembly substrate and the optical print head, wherein the flexible flat cable supplies a driving signal for driving the light emitting element from the main assembly substrate to the optical print head; a first cover portion made of a resin material and provided in the supporting member so as to cover a first portion of a cutting plane of the opening, the first portion opposing one surface of the flexible flat cable; and a second cover portion made of a resin material and provided in the supporting member so as to cover a second portion of the cutting plane of the opening, the second portion opposing the other surface of the flexible flat cable.

According to another aspect of the present invention, there is provided an image forming apparatus comprising: a drum unit including a photosensitive drum rotatable relative to a main assembly; an optical print head including a light emitting element configured to emit light to which the photosensitive drum is exposed; a moving mechanism configured to reciprocate the optical print head between a contact position where the optical print head is contacted to the drum unit and a spaced position where the optical print head is spaced from the drum unit; a supporting member fixed to the main assembly and configured to support the moving mechanism, wherein the supporting member is made of metal and is provided with an opening formed by shearing; a main assembly substrate fixed to the main assembly; a flexible flat cable provided so as to pass through the opening and connecting the main assembly substrate and the optical print head, wherein the flexible flat cable supplies a driving signal for driving the light emitting element from the main assembly substrate to the optical print head; a first cover portion made of a resin material and provided in the supporting member so as to cover a first portion of a cutting plane of the opening, the first portion opposing one surface of the flexible flat cable, wherein the first cover portion has a bent surface contactable to the one surface; and a second cover portion provided in the supporting member so as to cover a second portion of the cutting plane of the opening, the second portion opposing the other surface of the flexible flat cable, wherein the second cover portion has a bent surface contactable to the other surface.

According to a further aspect of the present invention, there is provided an image forming apparatus comprising: a drum unit including a photosensitive drum rotatable relative to a main assembly; an optical print head including a light emitting element configured to emit light to which the photosensitive drum is exposed; a moving mechanism configured to reciprocate the optical print head between a contact position where the optical print head is contacted to the drum unit and a spaced position where the optical print head is spaced from the drum unit; a supporting member fixed to the main assembly and configured to support the moving mechanism, wherein the supporting member is made of metal and is provided with an opening formed by shearing; a main assembly substrate fixed to the main assembly; a flexible flat cable provided so as to pass through the opening and connecting the main assembly substrate and the optical print head, wherein the flexible flat cable supplies a driving signal for driving the light emitting element from the main assembly substrate to the optical print head; a first abutting portion made of a resin material and projecting from an edge of the opening toward one surface of the flexible flat cable than a cutting plane of the opening is; and a second abutting portion made of a resin material and projecting from the edge of the opening toward the other surface of the flexible flat cable.

According to another aspect of the present invention, there is provided an image forming apparatus comprising: a drum unit including a photosensitive drum rotatable relative to a main assembly; an optical print head including a light emitting element configured to emit light to which the photosensitive drum is exposed; a moving mechanism configured to reciprocate the optical print head between a contact position where the optical print head is contacted to the drum unit and a spaced position where the optical print head is spaced from the drum unit; a supporting member fixed to the main assembly and configured to support the moving mechanism, wherein the supporting member is made of metal and is provided with an opening formed by shearing; a main assembly substrate fixed to the main assembly; a flexible flat cable provided so as to pass through the opening and connecting the main assembly substrate and the optical print head, wherein the flexible flat cable supplies a driving signal for driving the light emitting element from the main assembly substrate to the optical print head; and a bent surface contactable to the flexible flat cable in a region of an edge of the opening opposing one surface of the flexible flat cable in a region of the edge of the opening opposing the other surface of the flexible flat cable.

According to a further aspect of the present invention, there is provided an image forming apparatus comprising: a drum unit including a photosensitive drum rotatable relative to a main assembly; an optical print head including a light emitting element configured to emit light to which the photosensitive drum is exposed; a moving mechanism configured to reciprocate the optical print head between a contact position where the optical print head is contacted to the drum unit and a spaced position where the optical print head is spaced from the drum unit; a supporting member fixed to the main assembly and configured to support the moving mechanism, wherein the supporting member is made of metal and is provided with an opening formed by shearing; a main assembly substrate fixed to the main assembly; a flexible flat cable provided so as to pass through the opening and connecting the main assembly substrate and the optical print head, wherein the flexible flat cable supplies a driving signal for driving the light emitting element from the main assembly substrate to the optical print head; and a protective member made of a resin material and provided on the flexible flat cable so as to protect the flexible flat cable from contact with a cutting plane of the opening, the protective member being provided in an opposing region capable of opposing the cutting plane with respect to a perpendicular direction perpendicular to both of a rotational axis direction of the photosensitive drum and a direction in which the optical print head is reciprocated.

Further features of the present invention will become apparent from the following description of exemplary embodiments with reference to the attached drawings.

BRIEF DESCRIPTION OF THE DRAWINGS

Parts (a) and (b) of FIG. 1 are schematic sectional views each showing an image forming apparatus.

Parts (a) and (b) of FIG. 2 are schematic perspective views showing a drum unit and a periphery thereof in the image forming apparatus.

Figure 4:
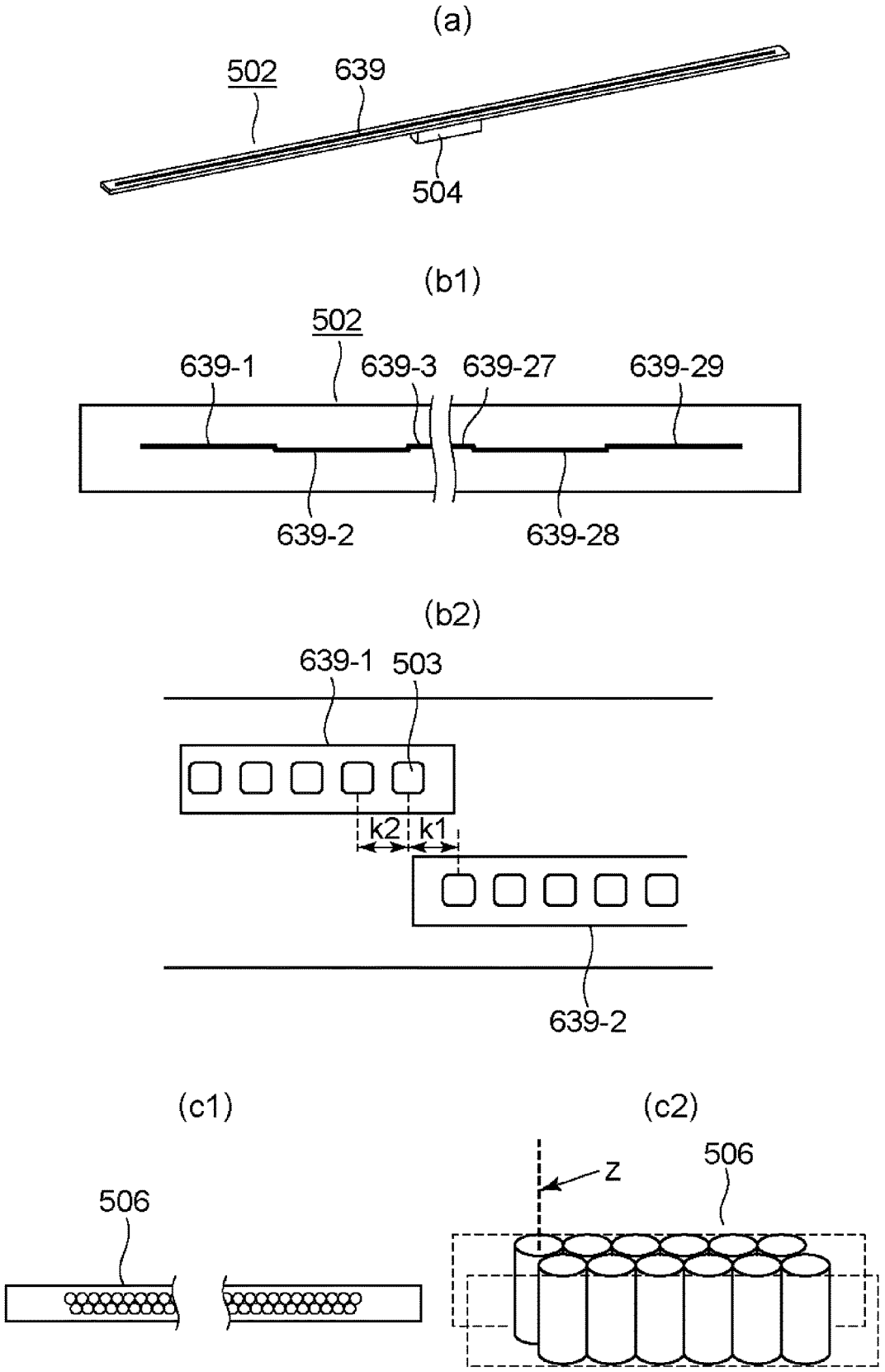

Parts (a), (b1), (b2), (c1) and (c2) of FIG. 4 are schematic views for illustrating a substrate, an LED chip or a lens array of an optical print head.

Figure 5:
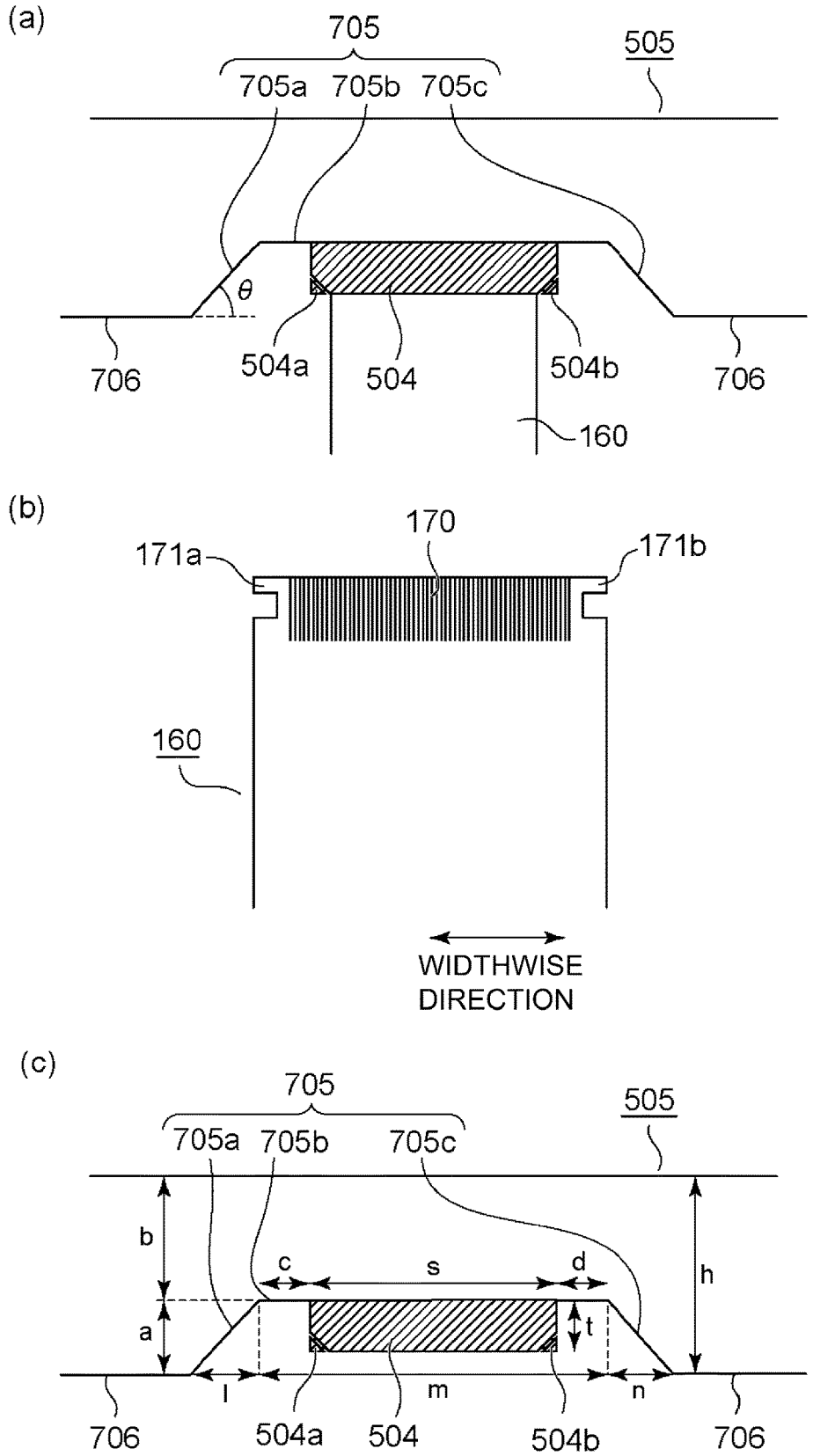

Parts (a), (b) and (c) of FIG. 5 are schematic views for illustrating a constitution in which a cable is mounted to and dismounted from a connector.

Figure 6:
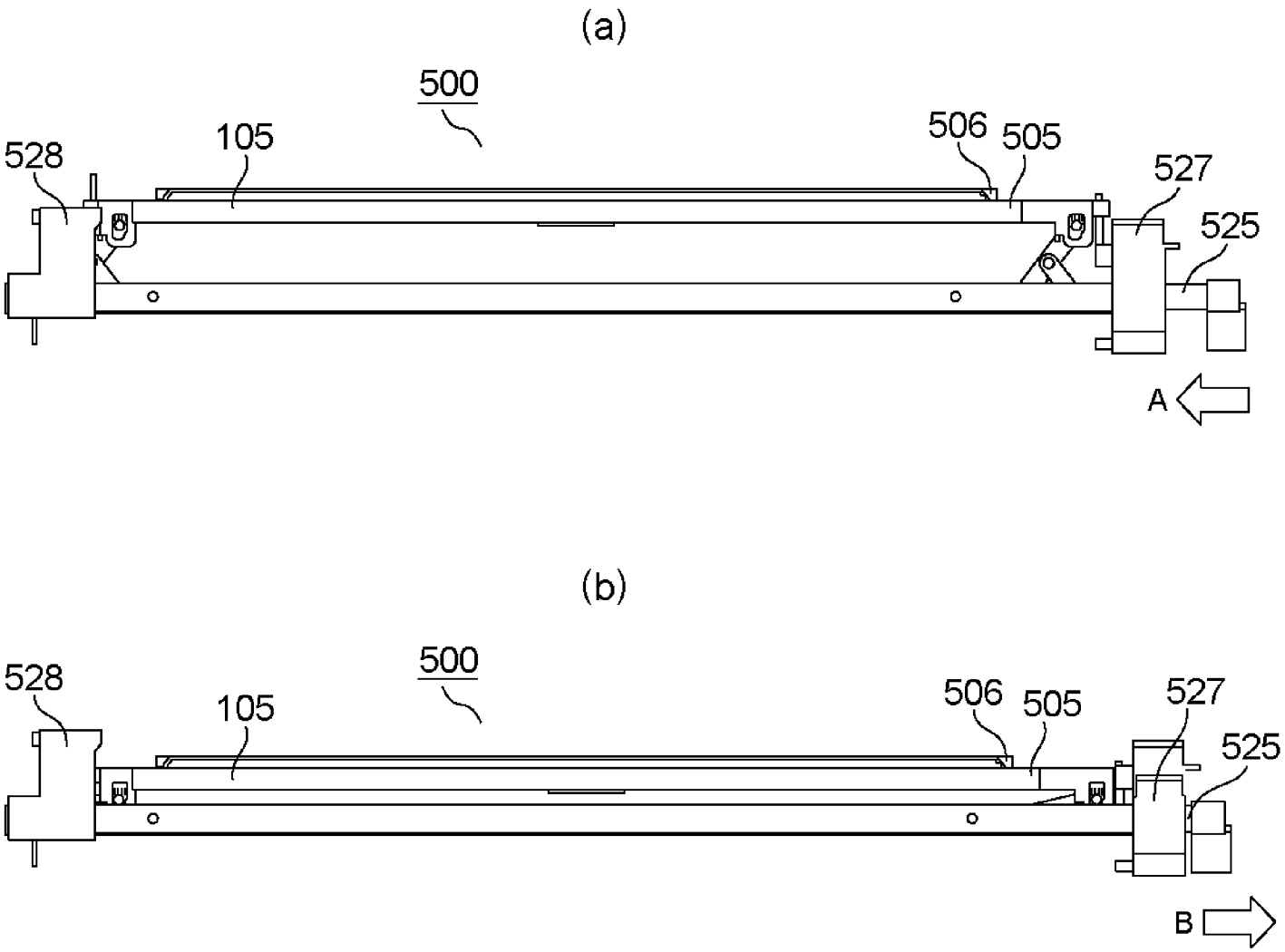

Parts (a) and (b) of FIG. 6 are side views of the optical print head.

Figure 7:
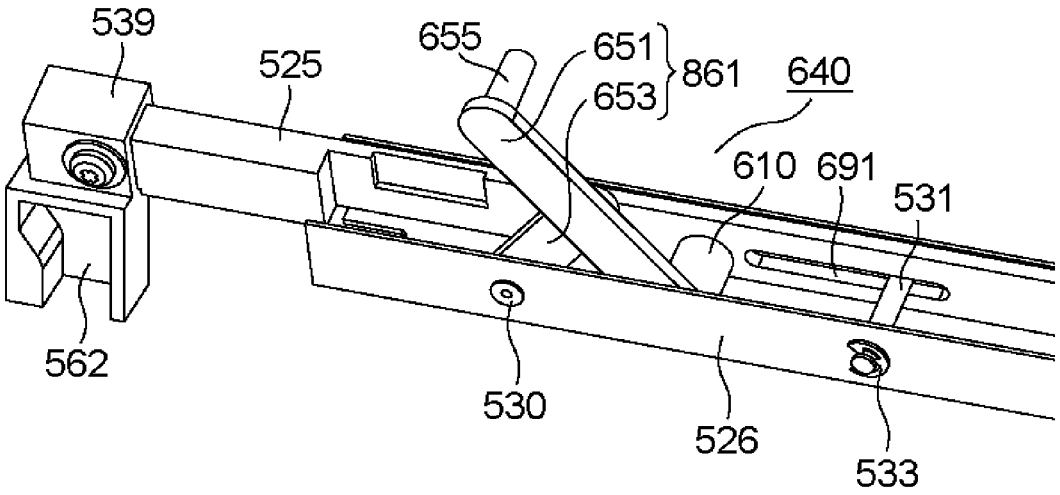
Figure 7:
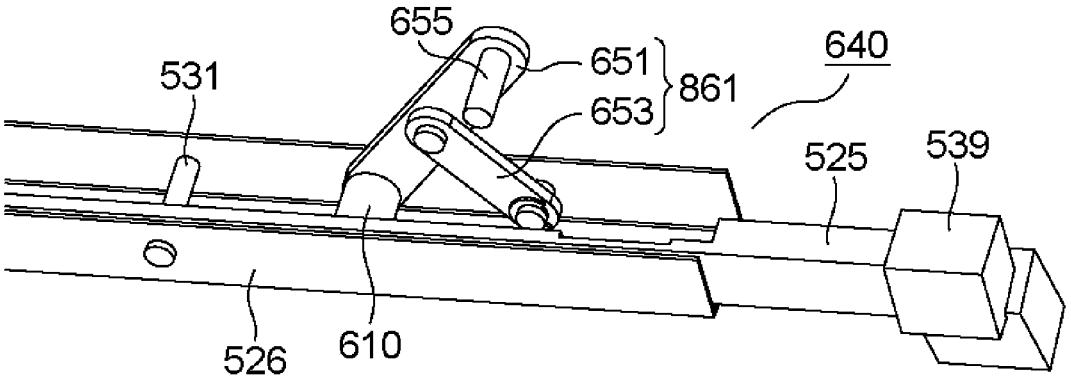

Parts (a) and (b) of FIG. 7 are perspective views of a moving mechanism.

Figure 8:
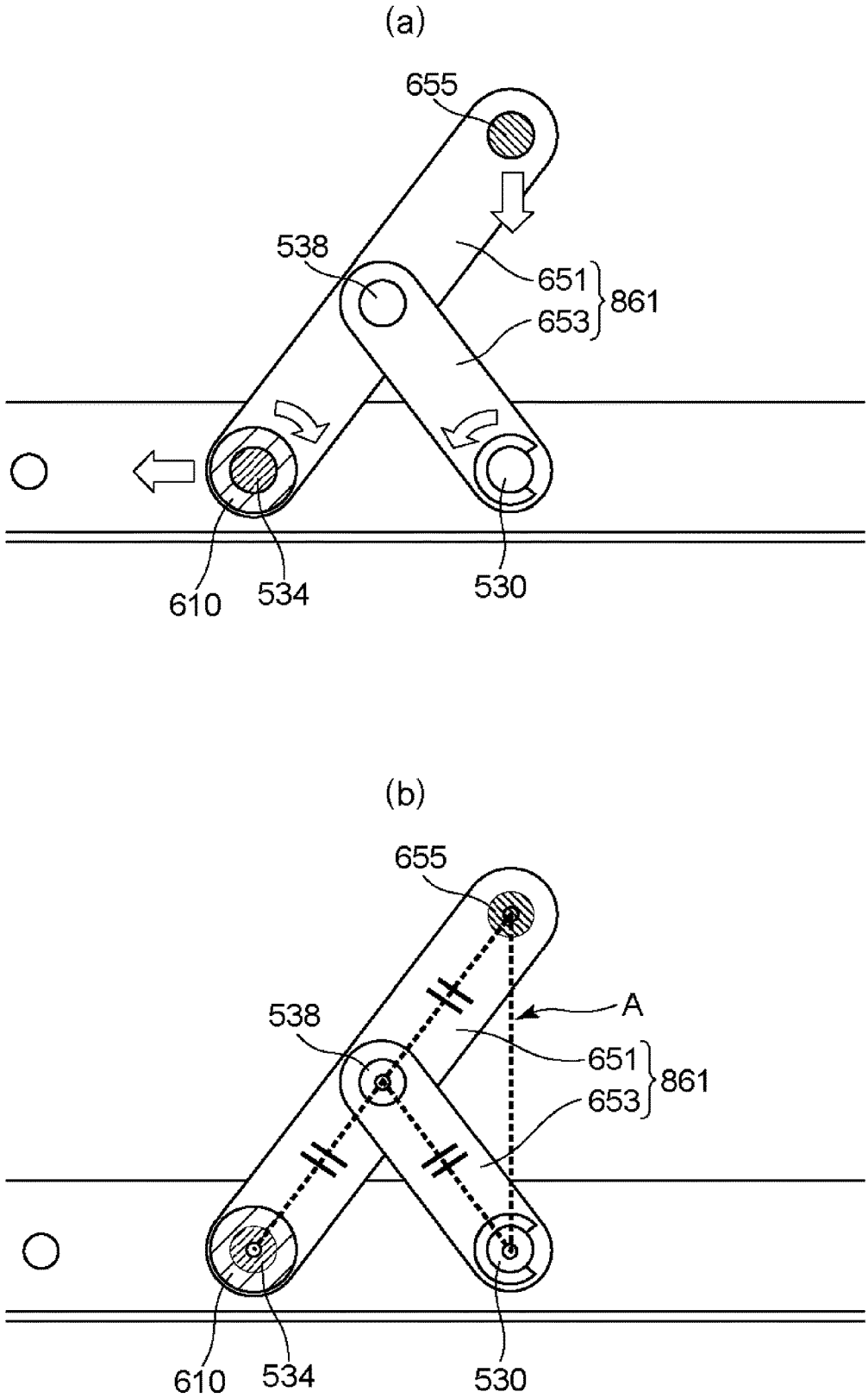

Parts (a) and (b) of FIG. 8 are side views of a first link mechanism of λ type.

Figure 9:
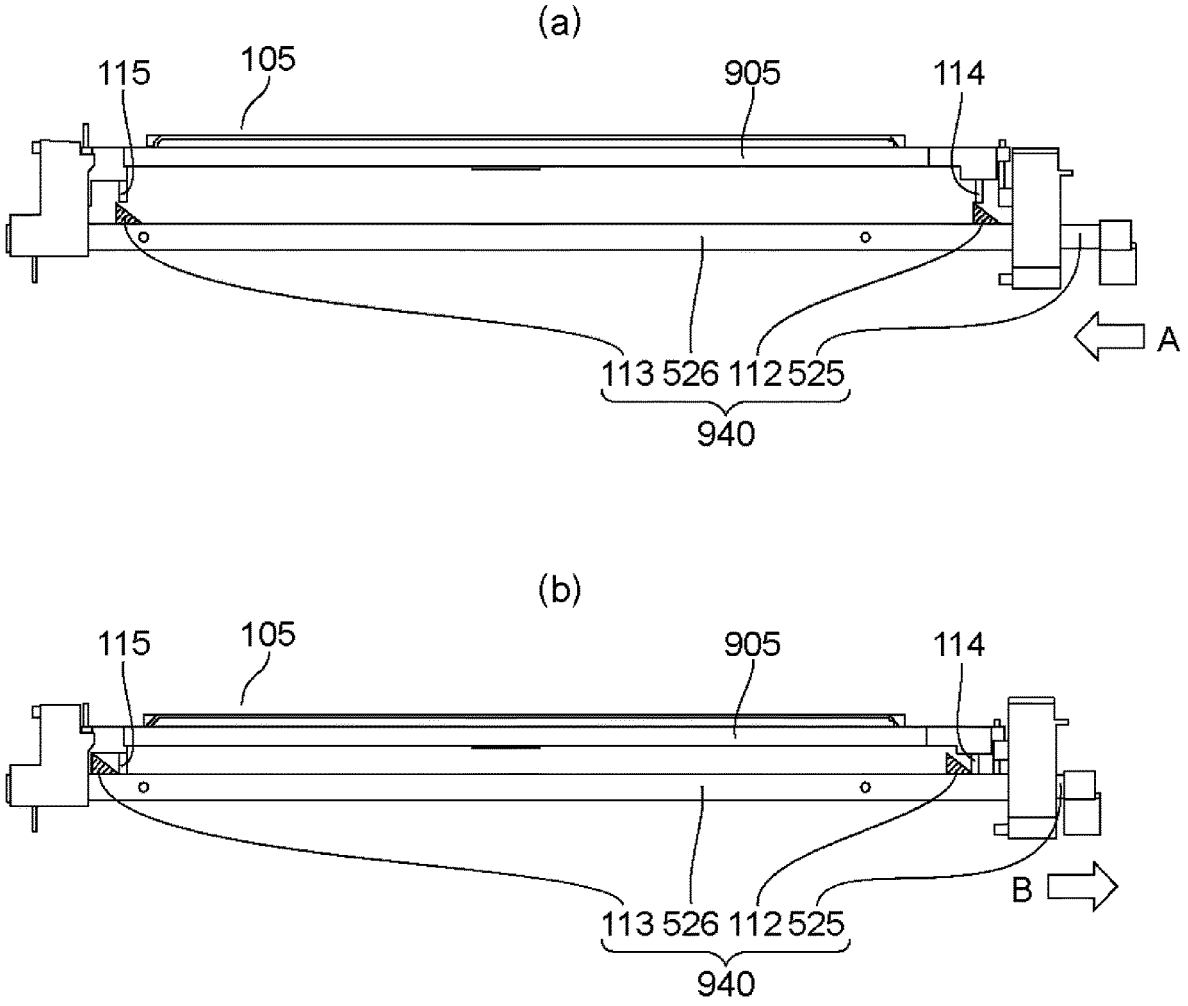

Parts (a) and (b) of FIG. 9 are schematic views for illustrating the moving mechanism using a cam mechanism.

Figure 10:
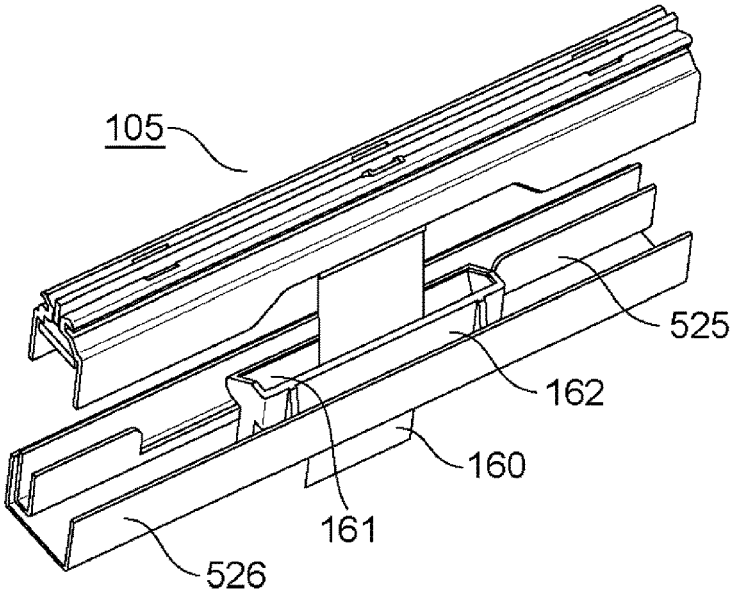
Figure 10:
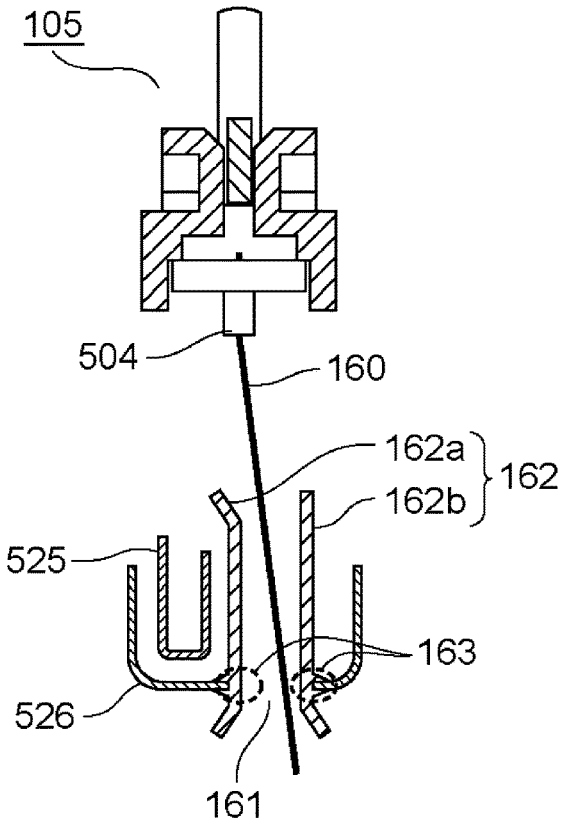

Parts (a) and (b) of FIG. 10 are schematic views for illustrating a structure of an opening.

Figure 11:
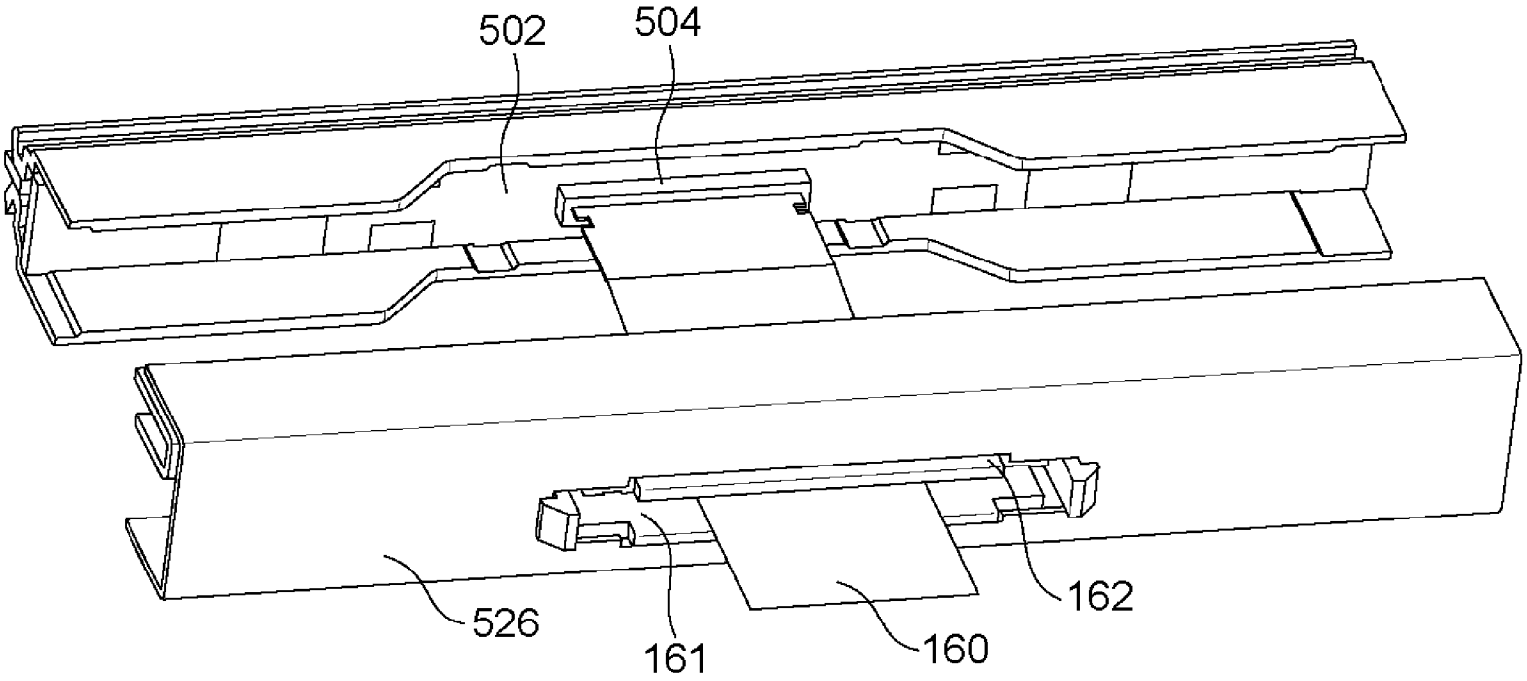

FIG. 11 is a perspective view of the opening as seen from a side below the opening.

Figure 12:
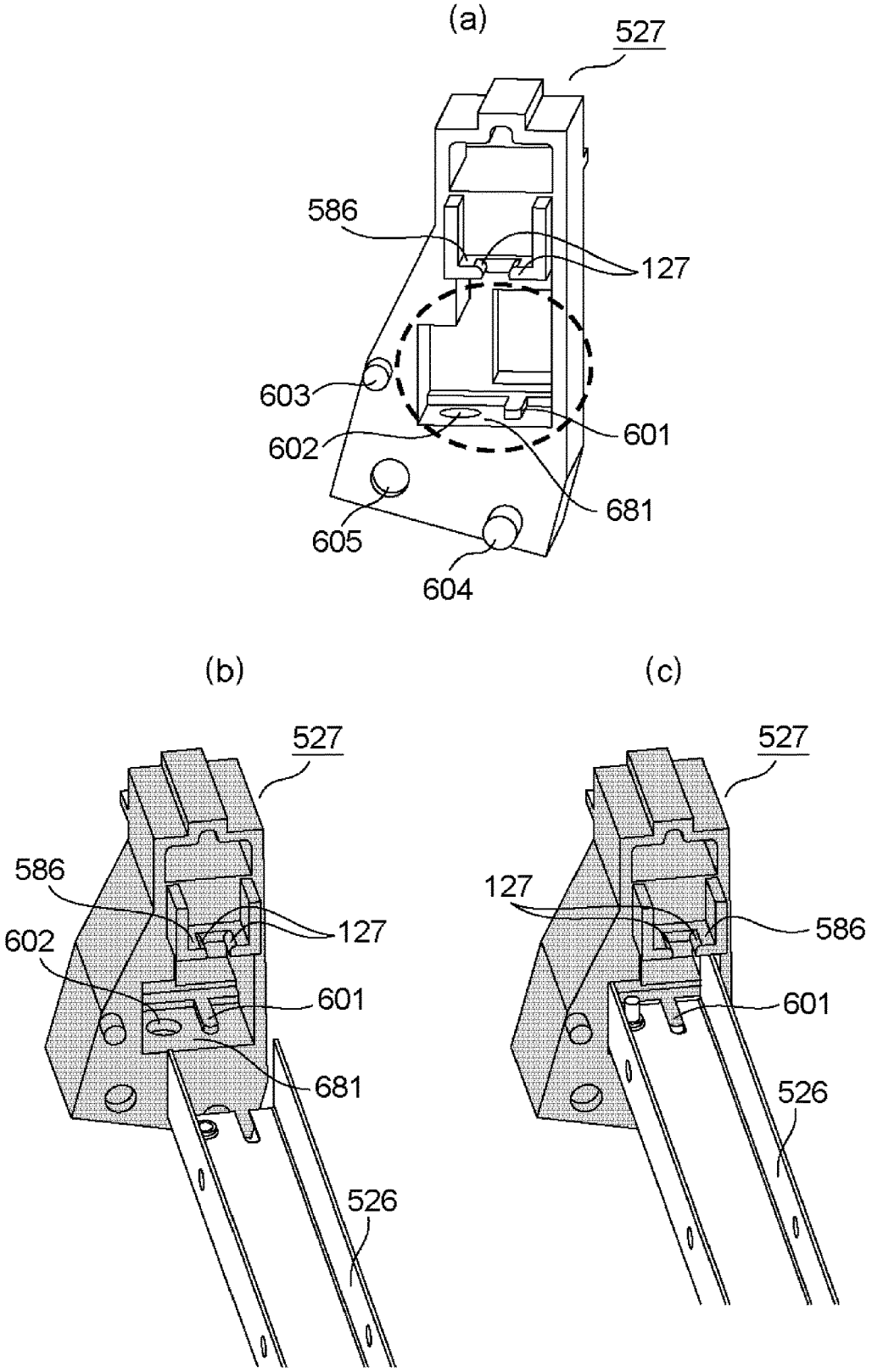

Parts (a), (b) and (c) of FIG. 12 are perspective views of a first supporting portion and a third supporting portion.

Figure 13:
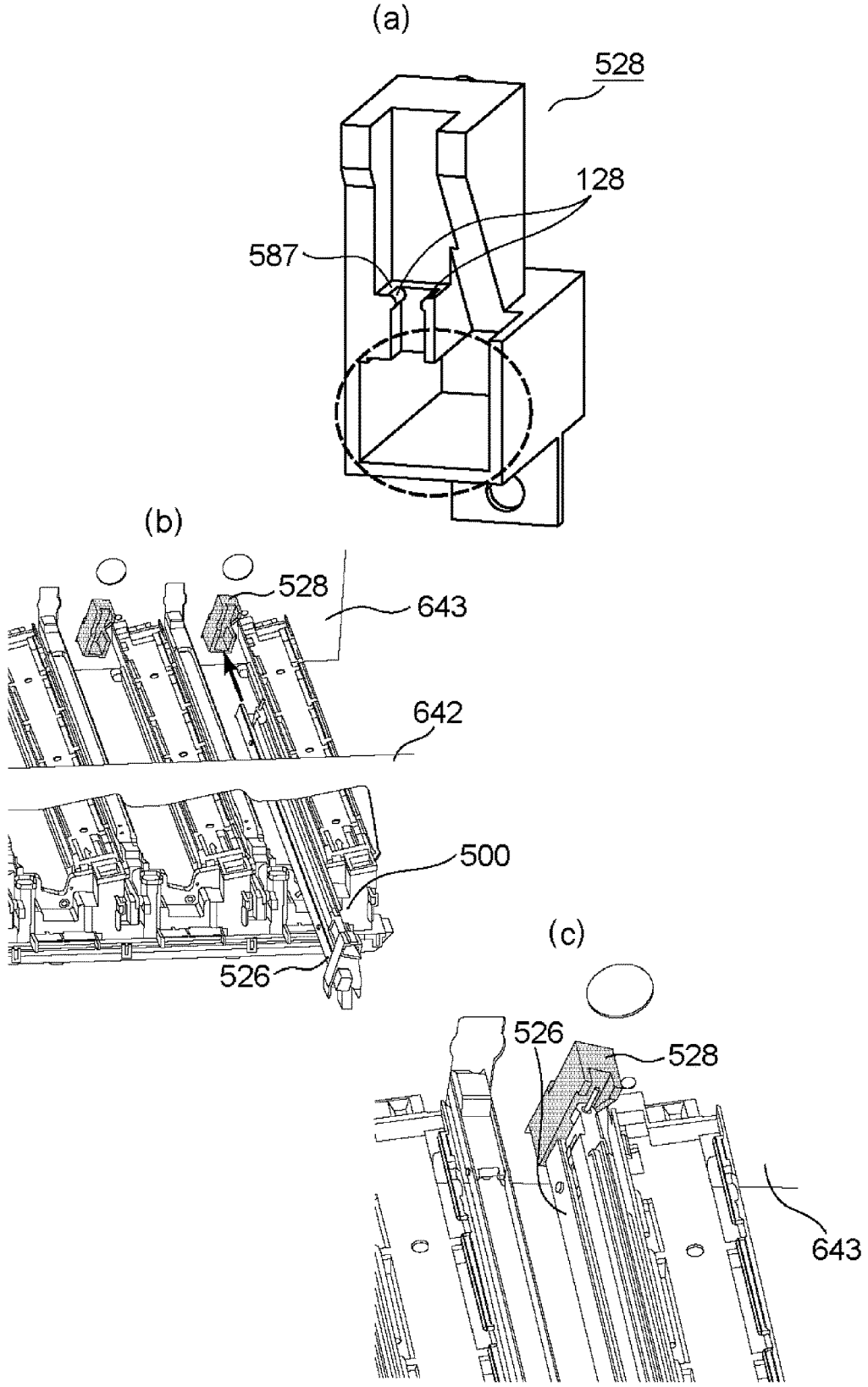

Parts (a), (b) and (c) of FIG. 13 are perspective views of a second supporting portion, a rear side plate and an exposure unit mounted on the second supporting portion.

Figure 14:
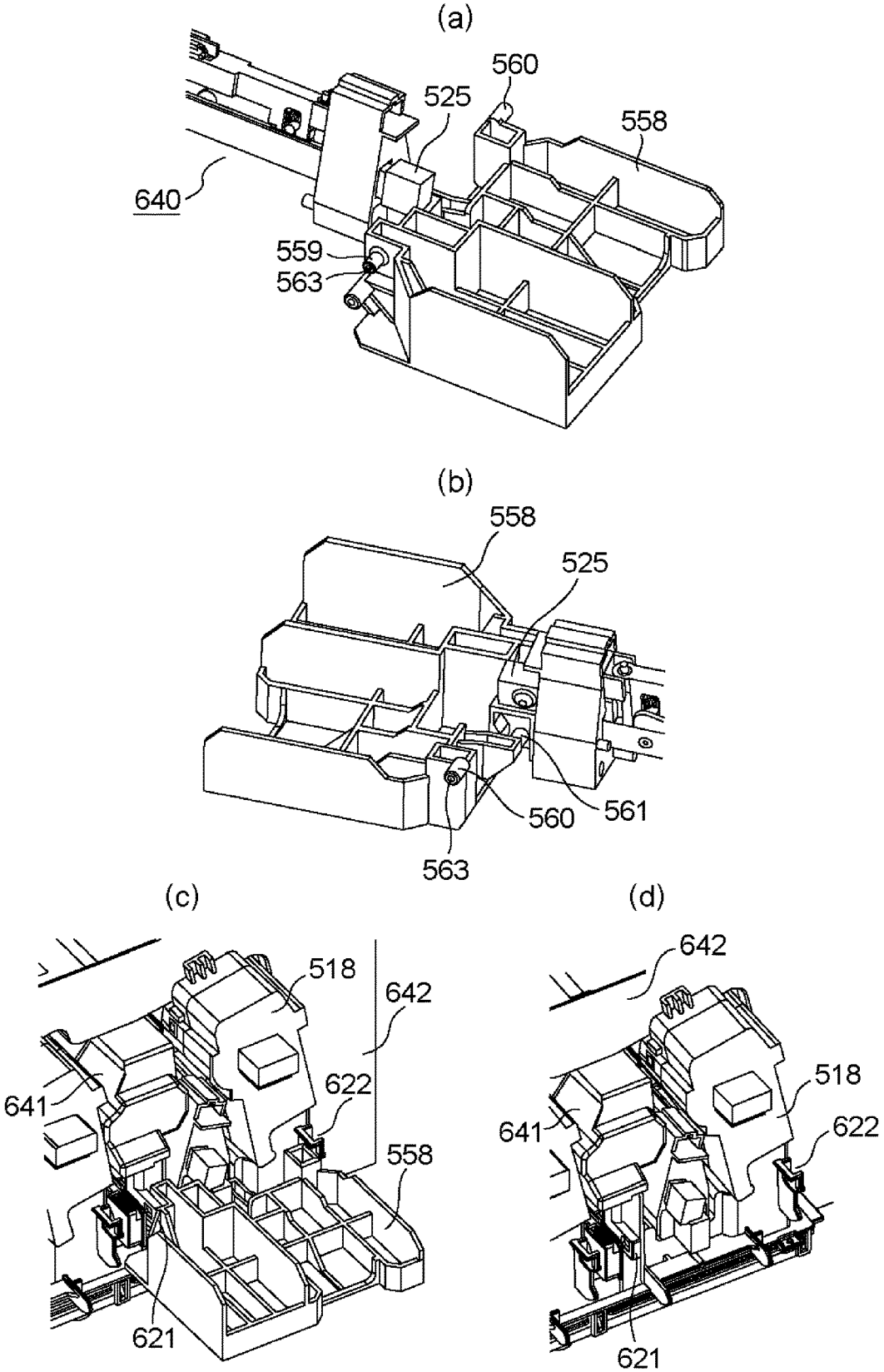

Parts (a) to (d) of FIG. 14 are perspective views of a cover.

Figure 15:
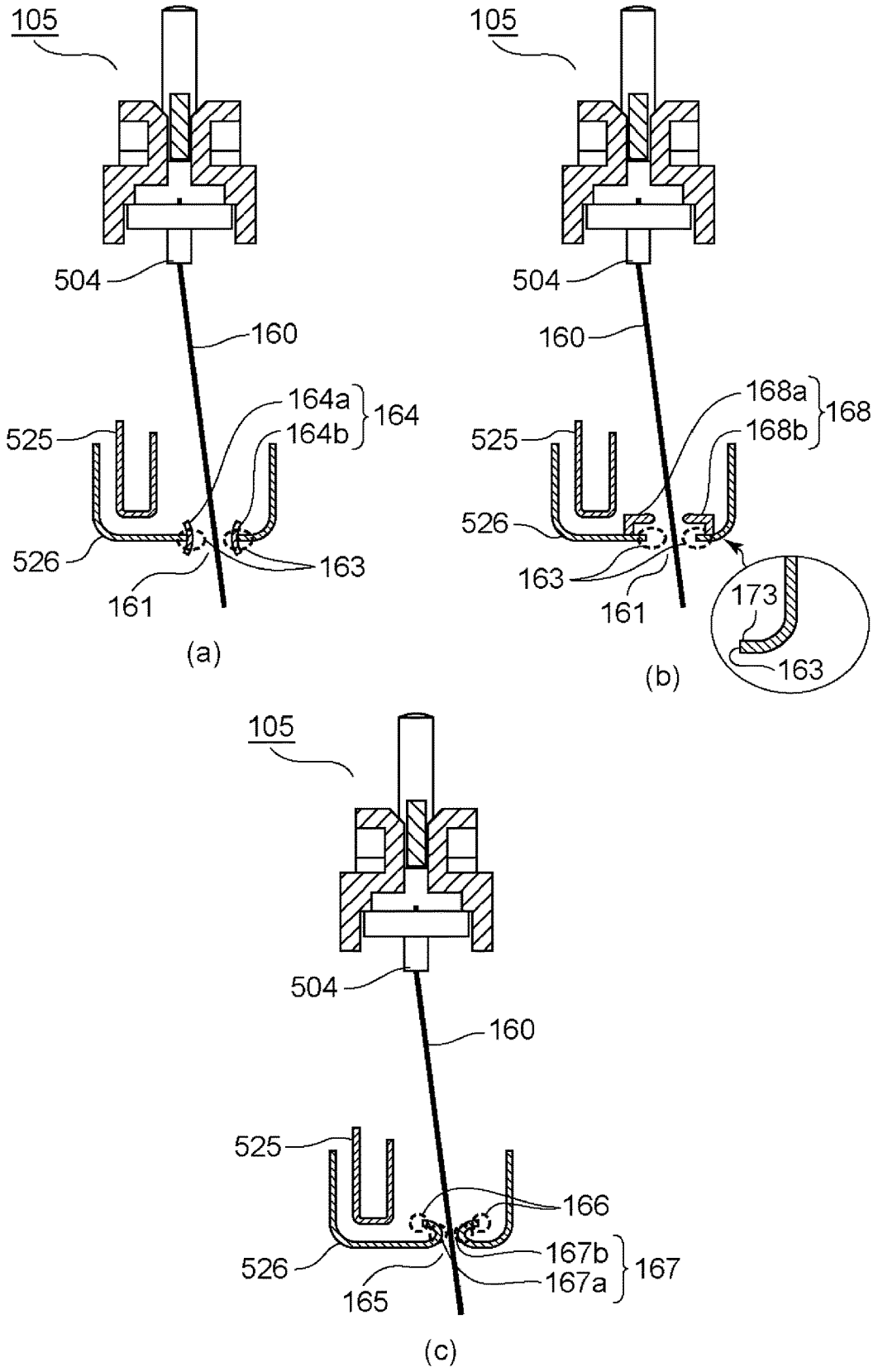

Parts (a), (b) and (c) of FIG. 15 are schematic views each for illustrating a structure of an opening in another Embodiment.

Figure 16:
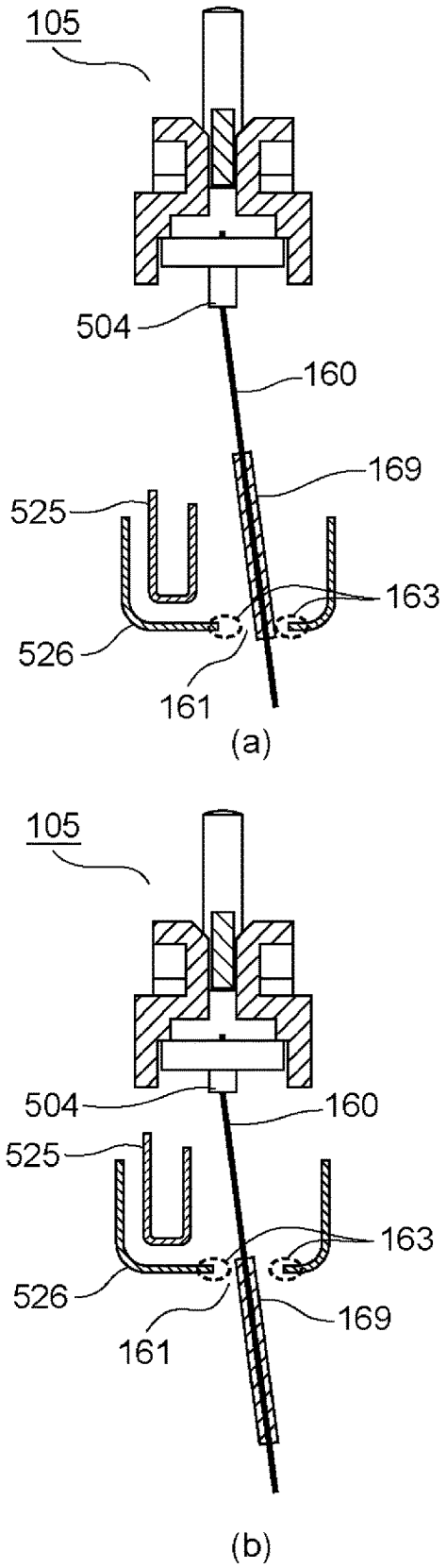

Parts (a) and (b) of FIG. 16 are schematic views for illustrating a constitution in which an FFC is provided with a protective member.

DESCRIPTION OF EMBODIMENTS

In the following, embodiments for carrying out the present invention will be described using the attached drawings. However, constituent elements described in the following embodiments are merely examples, and the present invention is not limited to those in the following embodiments.

Embodiment 1

(Image Forming Apparatus)

Figure 1:
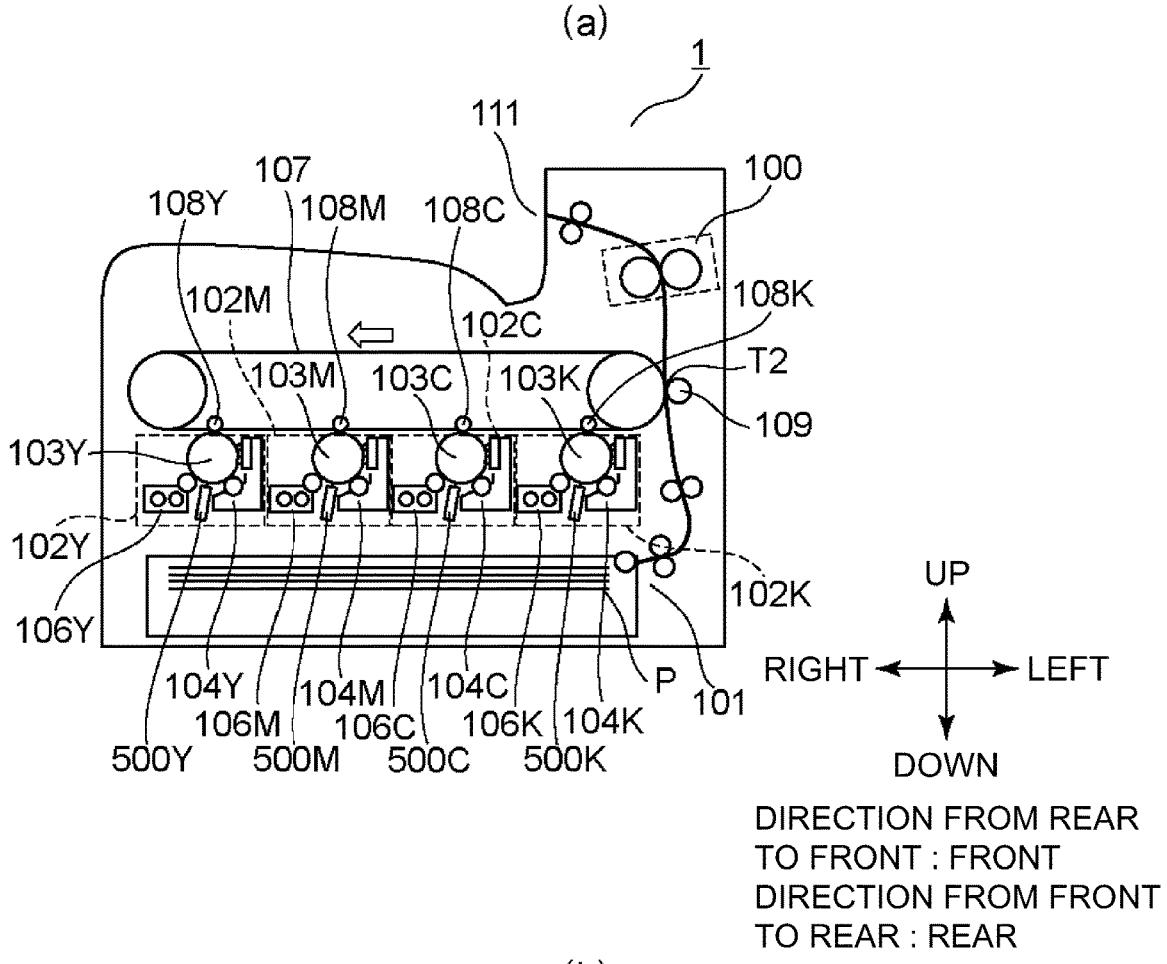
Figure 1:
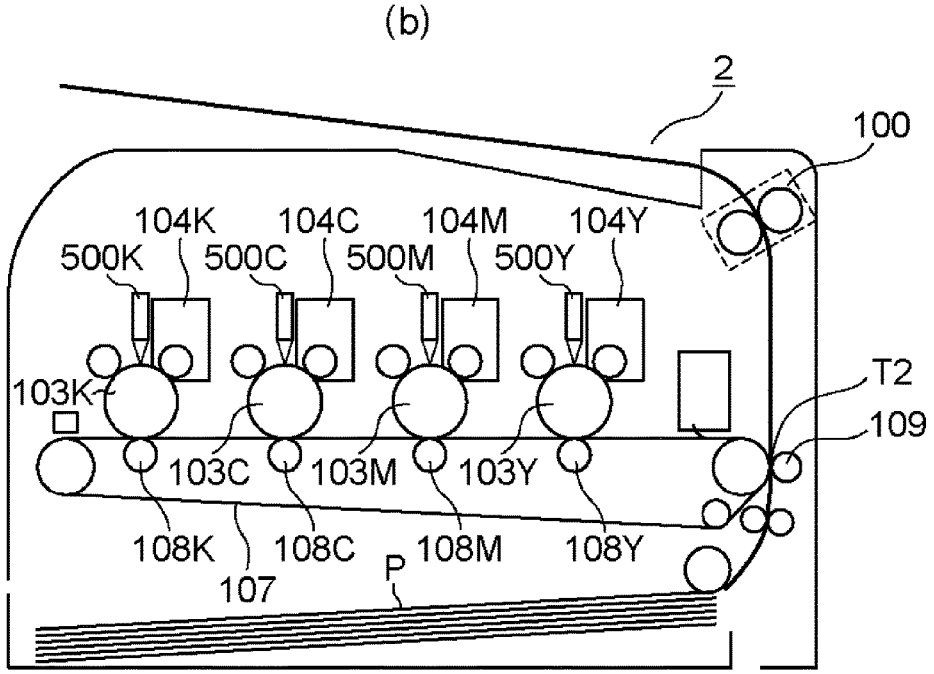

First, a schematic structure of an image forming apparatus 1 will be described. Part (a) of FIG. 1 is a schematic sectional view of the image forming apparatus 1. The image forming apparatus 1 shown in part (a) of FIG. 1 is a color printer (SFP: single function printer) including no reading device but may also be a copying machine including a reading device. Further, the image forming apparatus in this embodiment is not limited to a color image forming apparatus including a plurality of photosensitive drums 103 but may also be a color image forming apparatus including a single photosensitive drum 103 or an image forming apparatus for forming a monochromatic image.

The image forming apparatus 1 shown in part (a) of FIG. 1 includes four image forming portions 102Y, 102M, 102C and 102K (hereinafter collectively referred simply to as also an "image forming portion 102") for forming toner images of yellow, magenta, cyan and black, respectively. The image forming portions 102Y, 102M, 102C and 102K include photosensitive drums 103Y, 103M, 103C and 103K ("photosensitive drum 103"), and charging devices 104Y, 104M, 104C and 104K ("charging device 104") for electrically charging the photosensitive drums 103Y, 103M, 103C and 103K, respectively. The image forming portions further include LED (light emitting diode) exposure units 500Y, 500M, 500C and 500K ("exposure unit 500") as light sources for emitting light (beams) to which the photosensitive drums 103Y, 103M, 103C and 103K are exposed, respectively, and developing devices 106Y, 106M, 106C and 106K ("developing device 106") each for developing an electrostatic latent image on the photosensitive drum 103 with toner into a toner image of an associated color on the photosensitive drum 103. Incidentally, suffixes Y, M, C and K of the respective constituent elements represent colors of the toners.

The image forming apparatus 1 shown in part (a) of FIG. 1 is an image forming apparatus employing a so-called "lower surface exposure type" in which the photosensitive drum 103 is exposed to light from below. In the following, description will be made on the precondition that the image forming apparatus employing the lower surface exposure type is used, but in this embodiment, an image forming apparatus employing an "upper surface exposure type" in which the photosensitive drum 3 is exposed to light from above, such as an image forming apparatus 2 shown in part (b) of FIG. 1 may also be used.

The image forming apparatus 1 includes an intermediary transfer belt 107 onto which the toner images formed on the photosensitive drums 3 are to be transferred and primary transfer rollers 108Y, 108M, 108C and 108K) for successively transferring the toner images from the photosensitive drums 103 onto the intermediary transfer belt 107. The image forming apparatus 1 further includes a secondary transfer roller 109 for transferring the toner images from the intermediary transfer belt 107 onto recording paper P fed from a paper feeding portion 101 and includes a fixing device 100 for fixing the secondary-transferred toner images on the recording paper P.

(Image Forming Process)

The exposure unit 500 exposes to light the surface of the photosensitive drum 103Y charged by the charging device 104Y. As a result, the electrostatic latent image is formed on the photosensitive drum 103Y. Then, the developing device 106Y develops the electrostatic latent image, formed on the photosensitive drum 103Y, with yellow toner. A resultant yellow toner image formed on the photosensitive drum 103Y through development of the electrostatic latent image is transferred onto the intermediary transfer belt 107 by the primary transfer roller 108Y. The toner images of magenta, cyan and black are also transferred onto the intermediary transfer belt 107 by a similar image forming process.

The respective color toner images transferred on the intermediary transfer belt 107 are fed to a secondary transfer portion T2 by the intermediary transfer belt 107. To the secondary transfer roller 109 disposed at the secondary transfer portion T2, a transfer bias for transferring the toner images onto the recording paper P has been applied. The toner images fed to the secondary transfer portion T2 are transferred, onto the recording paper P fed from the paper feeding portion 101, under application of the transfer bias to the secondary transfer roller 109. The recording paper P on which the toner images are transferred is fed to the fixing device 100. The fixing device 100 fixes the toner images on the recording paper P by heat and pressure. The recording paper P subjected to a fixing process by the fixing device 100 is discharged onto a paper discharge portion 111.

(Drum Unit and Developing Unit)

In the image forming apparatus 1 of this embodiment, drum units 518Y, 518M, 518C and 518K which are each an example of an exchangeable exchange unit is mounted. Each of the drum units 518 is a cartridge to be exchanged by an operator such as a user or a maintenance person. The drum unit 518 in this embodiment includes the photosensitive drum 103. The photosensitive drum 103 is supported by the drum unit 518 so as to be rotatable relative to a frame of the drum unit 518. Incidentally, the drum unit 518 may also have a constitution in which the charging unit 104 and a cleaning device are provided.

Further, in the image forming apparatus 1 of this embodiment, a developing unit 641 which is a separate member from the drum unit 518 is mounted. The developing unit 641 is a cartridge prepared by integrally assembling the developing device 106 shown in part (a) of FIG. 1 and a toner accommodating portion into a unit. The developing unit 641 includes a developing sleeve for carrying a developer (toner and a carrier). The developing unit 641 is provided with a plurality of gears for rotating a screw for stirring the toner and the carrier. When these gears are aging-deteriorated or the like, the operator dismounts the developing unit 641 from the apparatus main assembly of the image forming apparatus 1 and exchanges the developing unit 641 with new one. Incidentally, the forms of the drum unit 518 and the developing unit 641 may also be a process cartridge prepared by integrally assembling the drum unit 518 and the developing unit 641 into a unit.

Figure 2:
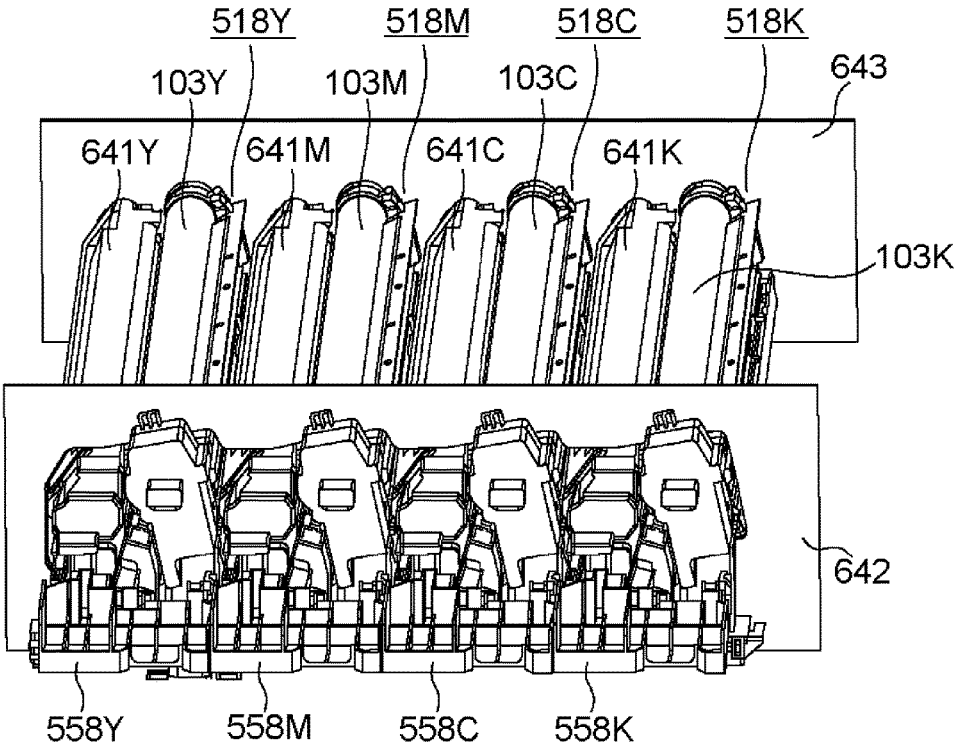
Figure 2:
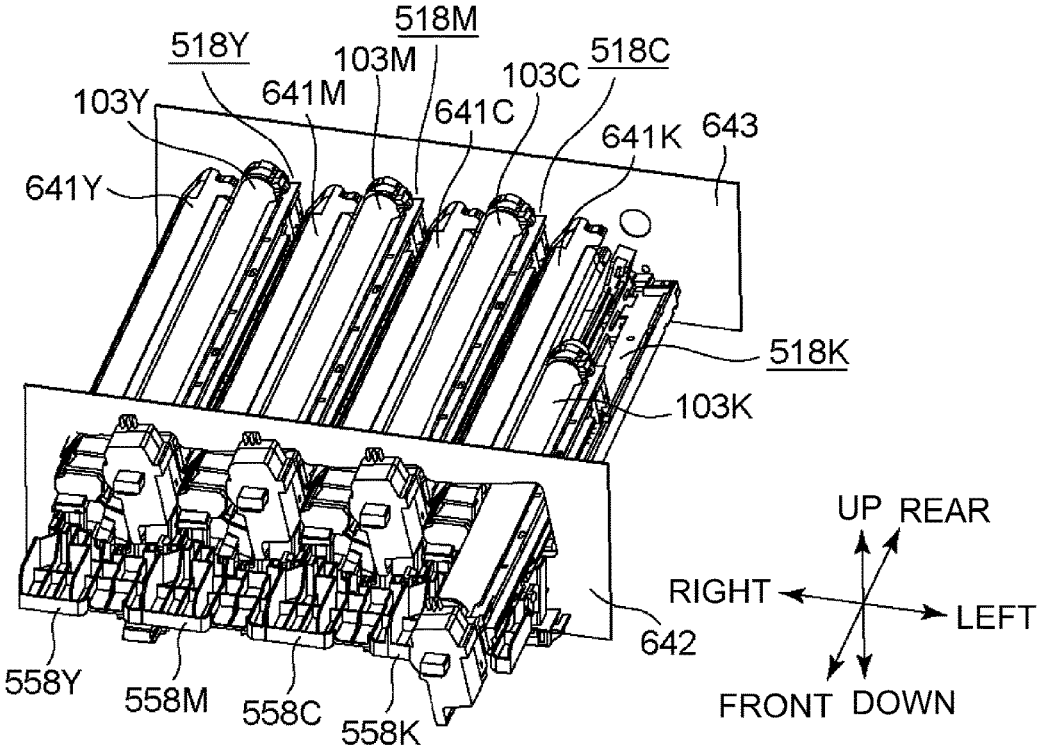

Part (a) of FIG. 2 is a perspective view showing a schematic structure of the drum unit 518, the developing unit 641 and peripheral portions thereof. Part (b) of FIG. 2 is a perspective view showing a state in which the drum unit 518 is being inserted from an outside of the apparatus main assembly into the image forming apparatus 1.

As shown in part (a) of FIG. 2, the image forming apparatus 1 includes a front side plate 642 formed with a metal plate and a rear side plate 643 formed with a metal plate. The front side plate 642 is a side wall provided on a front side of the image forming apparatus 1. The rear side plate 643 is a side wall provided on a rear side of the image forming apparatus 1. As shown in part (a) of FIG. 2, the front side plate 642 and the rear side plate 643 are disposed opposed to each other, and an unshown metal plate as a beam is bridged between these plates. Each of the front side plate 642, the rear side plate 643 and the unshown beam constitutes a part of a frame of the image forming apparatus 1.

The front side plate 642 is provided with an opening through which the drum unit 518 and the developing unit 641 can be inserted from the front side into and extracted from the image forming apparatus 1. The drum unit 518 and the developing unit 641 are mounted at a predetermined position of the main assembly of the image forming apparatus 1 through the opening (mounting position). Further, the image forming apparatus 1 includes a cover 558Y, 558M, 558C and 558K ("cover 558") for covering a front side of both of the drum unit 518 and the developing unit 641 which are mounted in the mounting position. The cover 558 is fixed at one end thereof to the main assembly of the image forming apparatus 1 by a hinge, whereby the cover 558 is rotatable relative to the main assembly of the image forming apparatus 1. The operator for performing maintenance opens the cover 558 and takes the drum unit 518 or the developing unit 641 out of the image forming apparatus 1, and then inserts a new drum unit 518 or a new developing unit 641 into the image forming apparatus 1 and closes the cover 558, whereby an exchanging operation is completed. The cover 558 will be further specifically described later.

Here, as shown in parts (a) and (b) of FIG. 2, in the following description, the front side plate 641 side and the rear side plate 643 side are defined as a front side and a rear side, respectively. Further, when a position of the photosensitive drum 103K on which the electrostatic latent image relating to the black toner image is formed is taken as a reference position, a side where the photosensitive drum 103Y on which the electrostatic latent image relating to the yellow toner image is formed is disposed is defined as a right side. Further, when a position of the photosensitive drum 103Y is taken as a reference position, a side where the photosensitive drum 103K is disposed is defined as a left side. Further, with respect to a direction perpendicular to a front-rear direction and a left-right direction, an upward direction in a vertical direction is defined as an up direction and a downward direction in the vertical direction is defined as a down direction. The front direction, the rear direction, the right direction, the left direction, the up direction and the down direction defined above are shown in part (b) of FIG. 2. Further, in the following description, with respect to a rotational axis direction of the photosensitive drum 3, one end side means the front side and the other end side means the rear side. Further, one end side and the other end side with respect to the front-rear direction also correspond to the front side and the rear side, respectively. Further, with respect to the left-right direction, one end side means the right side and the other end side means the left side.

(Exposure Unit)

Next, the exposure unit 500 including an optical print head 105 will be described. Here, as an example of an exposure type employed in an image forming apparatus of an electrophotographic type, there is a laser beam scanning exposure type in which a beam emitted from a semiconductor laser is deflected for scanning by a rotating polygon mirror and the photosensitive drum 1 is exposed to the beam through an f-θ lens or the like. The "optical print head 105" described in this embodiment is used in an LED exposure type apparatus in which the photosensitive drum 103 is exposed to light by using light emitting elements such as LEDs or the like arranged along the rotational axis direction of the photosensitive drum 103 and thus is not used in the laser beam scanning exposure type described above.

Figure 3:
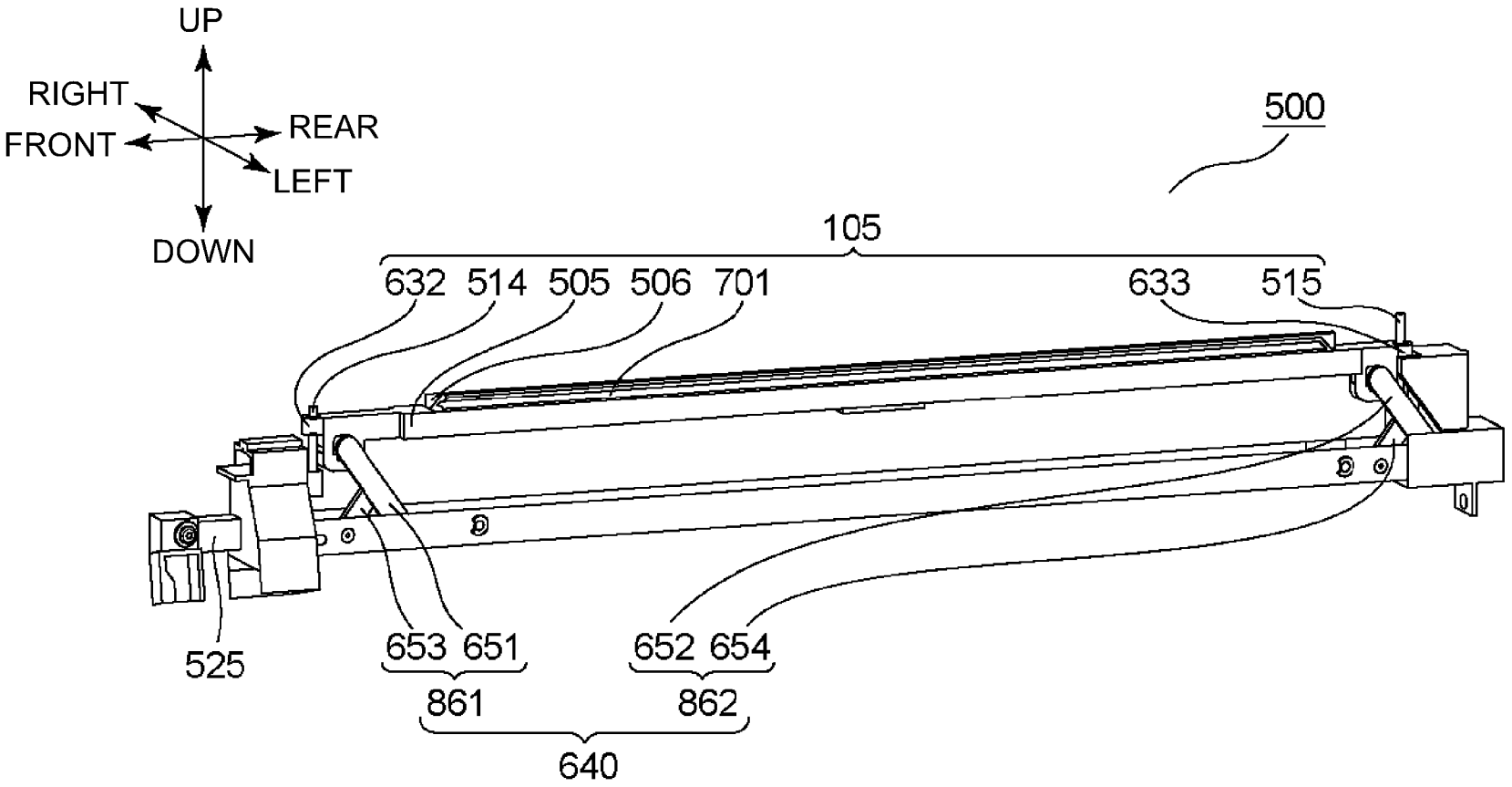
FIG. 3 is a schematic perspective view of an exposure unit.

The exposure unit 500 described in this embodiment is provided on a side below a rotational axis of the photosensitive drum 103 with respect to the vertical direction, and the photosensitive drum 103 is exposed to light from below by LEDs 503 of the optical print head 105. However, a constitution in which the exposure unit 500 is provided on a side above the rotational axis of the photosensitive drum 103 with respect to the vertical direction and in which the photosensitive drum 103 is exposed to light from above by the LEDs 503 of the optical print head 105 may also be employed (part (b) of FIG. 1). FIG. 3 is a schematic perspective view of the exposure unit 500 provided in the image forming apparatus 1 of this embodiment.

Referring to FIG. 3, the exposure unit 500 includes the optical print head 105 and a moving mechanism 640. The optical print head 105 includes a lens array 506, a lens mounting portion 701, a holding member 505 for holding a substrate 502 (not shown in FIG. 3), a first contact member 514 (an example of a prevention), a second contact member 515 (an example of a projection) and pin mounting portions 632 and 633 on which the first contact member 514 and the second contact member 515 are mounted, respectively.

The first contact member 514 and the second contact member 515 contact the drum unit 518, so that a gap (interval) is formed between the lens array 506 and the photosensitive drum 103, and thus a position of the optical print head 105 during image formation is determined. The moving mechanism 640 includes a first link mechanism 861, a second link mechanism 862 and a slidable portion 525. The first link mechanism 861 includes a link member 651 and a link member 653. The second link mechanism 862 includes a link member 652 and a link member 654. With an opening and closing operation of the unshown cover 558, the slidable portion 525 slides in the front-rear direction. In interrelation with the slide (movement) of the slidable portion 525, the first link mechanism 861 and the second link mechanism 862 are driven, so that the optical print head 105 is moved upward and downward. Of the frame of the drum unit 518, portions on which the contact members 514 and 515 abut, for example, engaging holes in which free end portions of these contact members 514 and 515 engage by about 5 mm are provided. As a result, the optical print head 105 is accurately positioned to the photosensitive drum 3. A specific operation mechanism of the moving mechanism will be described later.

Incidentally, in this embodiment, the first contact member 514 and the second contact member 515 will be described as cylindrical pins. However, the shape of the pins is not limited to a cylindrical shape but may also be a prism shape. Further, the shape of the pins may also be a conical shape such that a diameter decreases toward a point. Further, the first and second contact members 514 and 515 are not limited to the pins but may also be projections integrally molded with the holding member 505.

For explaining a structure of the optical print head 105, first, the holding member 505 will be described. The holding member 505 is a holder for holding the substrate 502, the lens array 506 as an example of a lens, the first and second contact members 514 and 515. A function of the first and second contact members 514 and 515 will be described specifically later. Incidentally, the holding member 505 in this embodiment is made of a resin material but may also be made of metal. In the following, projection lengths of the first and second members 514 and 515 from the holding member 505 are summarized.

First contact member 514 projecting from upper surface of holding member 505: 7 mm Second contact member 515 projecting from upper surface of holding member 505: 11 mm First contact member 514 projecting from lower surface of holding member 505: 22 mm Second contact member 515 projecting from lower surface of holding member 505: 22 mm Next, the substrate 502 held by the holding member 505 will be described. Part (a) of FIG. 4 is a schematic perspective view of the substrate 502. Part (b1) of FIG. 4 is a schematic view showing an arrangement of a plurality of LEDs 503 provided on the substrate 502. Part (c) of FIG. 4 is an enlarged view of part (b1) of FIG. 4.

On the substrate 502, LED chips 639 are mounted. As shown in part (a) of FIG. 4, on one surface of the substrate 502, the LED chips 639 are provided, and on the other surface (opposite to the side (surface) on which the light emitting elements are arranged) of the substrate 502, an elongated connector 504 is provided. The connector 504 is mounted on a lower surface of the substrate 502 so that a longitudinal direction thereof extends along a longitudinal direction of the substrate 502. On the substrate 502, electrical wiring for supplying signals to the respective LED chips 639 is formed. To the connector 504, one end of a flexible flat cable (FFC) 160 (not shown in part (a) of FIG. 4) as an example of a cable is connected. In the image forming apparatus 1 main assembly, a substrate (main assembly substrate) including a controller and a connector is provided. The other end of the FFC 160 is connected to the connector. To the substrate 502, a control signal (driving signal) is inputted from the controller of the image forming apparatus 1 main assembly through the FFC and the connector 504.

The LED chips 639 mounted on the substrate 502 will be described further specifically. As shown in parts (b1) and (b2) of FIG. 4, on one surface of the substrate 502, a plurality of LED chips 639-1 to 639-29 (29 LED chips), each having a plurality of LEDs 503 (an example of the light emitting element), are disposed. On each of the LED chips 639-1 to 639-29, 516 LEDs 503 are arranged in a line along a longitudinal direction of the LED chips 639. With respect to the longitudinal direction of the LED chips 639, a center distance k2 between adjacent LEDs 503 corresponds to resolution of the image forming apparatus 1. The resolution of the image forming apparatus 1 is 1200 dpi, and therefore, in the longitudinal direction of the LED chips 639-1 to 639-29, the LEDs 503 are arranged in a line so that the center distance of the LEDs 503 is 21.16 μm. For that reason, an exposure range of the optical print head 105 in this embodiment is about 314 mm. A photosensitive layer on the photosensitive drum 103 is formed with a width of 314 mm or more. A long-side length of A4-size recording paper and a short-side length of A3-size recording paper are 297 mm, and therefore, the optical print head 105 in this embodiment has the exposure range in which the image can be formed on the A4-size recording paper and the A3-size recording paper.

The LED chips 639-1 to 639-29 are alternately disposed in two (parallel) lines along the rotational axis direction. That is, as shown in part (b1) of FIG. 4, odd-numbered LED chips 639-1, 639-3, . . . 639-29 counted from a left side are mounted on the substrate 502 in a line with respect to the longitudinal direction, and even-numbered LED chips 639-2, 639-4, . . . 639-28 counted from the left side are mounted on the substrate 502 in a line with respect to the longitudinal direction. By disposing the LED chips 639 in such a manner, as shown in part (b2) of FIG. 4, with respect to the longitudinal direction of the LED chips 639, a center distance k1 between one end of one (e.g., 639-1) of adjacent (different) LED chips 639 and the other end of the other one (e.g., 639-2) of the adjacent LED chips 639 can be made equal to the center distance k2 between the adjacent LEDs 503 on one (e.g., 639-1) of LED chips 503. Incidentally, in this embodiment, a constitution using the LEDs 503 as an exposure light source is described as an example, but as the exposure light source, an organic EL (electro luminescence) device may also be used.

Next, a lens array 506 will be described. Part (c1) of FIG. 4 is a schematic view of the lens array 506 as seen from the photosensitive drum 103 side. Further, part (c2) of FIG. 4 is a schematic perspective view of the lens array 506. As shown in part (c1) of FIG. 4, a plurality of lenses are arranged in two lines along an arrangement direction of the plurality of LEDs 503. The respective lenses are alternately disposed so that with respect to an arrangement direction of the lenses arranged in one line, one of lenses arranged in the other line contacts both of adjacent lenses arranged in the arrangement direction of the lenses arranged in the above-described one line. Each of the lenses is a cylindrical rod lens made of glass. Incidentally, a material of the lens is not limited to glass but may also be plastics. Also shapes of the lenses are not limited to the cylindrical shape but may also be a polygonal prism shape such as a hexagonal prism shape.

A broken line Z shown in part (c2) of FIG. 4 represents an optical axis of the lens. The optical print head 105 is movable by the moving mechanism 640 in a direction (up-down direction) roughly along the optical axis of the lens indicated by the broken line Z. The optical axis of the lens referred to herein means a line connecting a center of a light emergent surface of the lens and a focus of the lens. Emitted light emitted from the LED 503 enters the lens of the lens array 506. The lens has a function of focusing the emitted light entering the lens on the surface of the photosensitive drum 103. A mounting position of the lens array 506 relative to the lens mounting portion 701 (FIG. 3) is adjusted during assembling of the optical print head 105 so that a distance between a light emergent surface of the LED 503 and a light incident surface of the lens and a distance between a light emergent surface of the lens and the surface of the photosensitive drum are substantially equal to each other.

(Mounting and Dismounting of FFC Relative to Connector)

Parts (a) to (c) of FIG. 5 are schematic views for illustrating a mounting and dismounting structure between the connector 504 and the FFC 160. Part (a) of FIG. 5 is an enlarged view of a cut-away portion 705 formed on the holding member 505. In part (a) of FIG. 5, when an upper side on the drawing is taken as an upper side of the holding member 505, the cut-away portion 705 is formed at a lower end 706 of the holding member 505. The cut-away portion 705 is formed by three surfaces consisting of an inclined surface 705*a*, a bottom (surface) 705*b* and an inclined surface 705*c*. In this embodiment, an inclination angle θ of the inclined surface 705*a* with respect to the lower end 706 is 45°. The inclination angle θ is not limited to 45° but may also be an arbitrary value.

As shown in part (a) of FIG. 5, the cut-away portion 705 is formed on the holding member 505 so that the connector 504 for the substrate 502 is exposed from the holding member 505. During maintenance of the substrate 502 and during exchange of the FFC 160, the operator such as the user or the service person is required to dismount the FFC 160 from the connector 504. The holding member 505 is provided with the cut-away portion 705, so that the operator can easily grasp the connector 504. If the cut-away portion 705 is not formed on the holding member 505, the connector 504 is hidden inside the holding member 505. Here, it can be considered that a height of the lower end 706 is limited to approximately a level of the bottom 705*b*, but in that case, strength of the holding member 505 decreases. Particularly, in the case where the holding member 505 is a member made of a resin material, as a width of the holding member with respect to a vertical direction becomes narrow, the holding member 505 is more susceptible to the influence of gravitation and thus causes warpage with respect to the vertical direction. As in this embodiment, because the cut-away portion 705 is formed on the holding member 705, ease of access to the connector 504 can be improved while maintaining the strength of the holding member with respect to the vertical direction.

The connector 504 in this embodiment is provided with pressing portions 504*a* and 504*b*. These pressing portions 504*a* and 504*b* are constituted so as to move in the longitudinal direction of the connector 504 relative to a main body of the connector 504. In a state in which the FFC 160 is connected to the connector 504, a connected state of the flexible flat cable 160 with the connector 504 is maintained by an unshown locking mechanism provided inside the connector 504. The pressing portions 504*a* and 504*b* are pressed, whereby a locked state of the FFC 160 to the connector 504 is eliminated. The operator pulls the FFC 160 from the connector 504 while pressing the pressing portions 504*a* and 504*b*, whereby the operator can dismount the FFC 160 from the connector 504.

Part (b) of FIG. 5 is an enlarged view of a free end portion of the FFC 160 in this embodiment. As shown in part (a) of FIG. 5, the FFC 160 includes a plurality of electroconductive lines arranged in parallel along a widthwise direction. The widthwise direction is the same direction as a lateral width direction of the FFC 160 and is as shown by an arrow in part (b) of FIG. 5. The FFC 160 is a flat cable coated with an insulation member. The region where the plurality of electroconductive lines are exposed from the insulation member at the free end portion of the FFC 160 is shown as a connecting region 170 in part (b) of FIG. 5. When the FFC 160 is connected with the connector 504, the connecting region 170 contacts an unshown metal terminal provided inside the connector 504.

With respect to the widthwise direction of the FFC 160, the width of the connecting region 170 is somewhat narrower than the width of the FFC 160. For that reason, with respect to the widthwise direction of the FFC 160, portions outside the connecting region 170 are insulation members. Further, with respect to the widthwise direction of the FFC 160, the portions outside the connecting region 170 are provided with grooves. As a result, at the free end portion of the FFC 160, projected portions 171*a* and 171*b* are formed.

When the FFC 160 is inserted into the connector 504, the projected portions 171*a* and 171*b* formed at the free end portion of the FFC 160 engage with an unshown locking mechanism provided inside the connector 504. The projected portions 171*a* and 171*b* are locked with claws as the locking mechanism, so that the FFC 160 cannot be pulled out of the connector 504. In a state in which the FFC 160 is connected with the connector 504, the pressing portions 504*a* and 504*b* are pressed, whereby an engaging state of the projected portions 171*a* and 171*b* with the claws is eliminated.

As shown in part (a) of FIG. 5, with respect to the longitudinal direction of the holding member 505, a certain gap (interval) is provided between the inclined surface 705*a* and the pressing portion 504*a* and between the inclined surface 705*b* and the pressing portion 504*b*. Thus, the gap between the inclined surfaces 705*a* and 705*b* is broader (larger) than the width of the connector 504 with respect to the longitudinal direction of the connector 504. For that reason, the operator can easily insert his (her) fingers into the gap between the inclined surface 705*a* and the pressing portion 504*a* and into the gap between the inclined surface 705*b* and the pressing portion 504*b*. The operator can pull the FFC 160 out of the connector 504, for example in a state in which the operator sandwiches the connector 504 with one hand, by the other hand.

Part (c) of FIG. 5 is a schematic view for illustrating a dimensional relationship between the cut-away portion 705 and the connector 504. A width h of the holding member 505 in this embodiment with respect to the vertical direction is 16 mm. The cut-away portion 705 is formed from the lower end 706 by 5 mm (width a in part (c) of FIG. 5). A width b from the bottom 705*b* of the cut-away portion 705 to a portion corresponding to an upper end of the holding member 505 is 11 mm. By cutting a portion, corresponding to a 5 mm-region shown by the height (width) a from the lower end 706, away from the holding member 505, the connector 504 is exposed from the bottom 705*b* of the cut-away portion 705. A width t of the connector 504 exposed from the bottom 705*b* is 3 mm. That is, the connector 504 is positioned on a side (where an unshown substrate 502 in this figure is positioned) above, with respect to the vertical direction, an extension line of the lower end 706 of the connector 504. A width of each of the pressing portions 504*a* and 504*b* with respect to the vertical direction is about 1 mm. For that reason, the pressing portions 504*a* and 504*b* are sufficiently exposed from the bottom 705*b*, and therefore, the operator can easily touch the pressing portions 504*a* and 504*b*.

A value of a width of the cut-away portion 705 with respect to the longitudinal direction of the holding member 505 is represented by a sum of widths 1, m and n in part (c) of FIG. 5, and is 52 mm. A width of the holding member 505 with respect to the longitudinal direction of the holding member 505 is about 330 mm, and therefore, a proportion of the width of the cut-away portion 705 to the width of the holding member 505 with respect to the longitudinal direction of the holding member 505 is about 16%.

A width s of the connector 504 with respect to the longitudinal direction of the connector 504 is 26 mm. A distance c from a boundary portion between the inclined surface 705*a* and the bottom 705*b* to an end portion of the connector 504 on the pressing portion 504*a* side with respect to the longitudinal direction of the connector 504 is 7 mm, a distance l from a boundary portion between the lower end 706 and the inclined surface 705*a* to a portion corresponding to the boundary portion between the inclined surface 705*a* and the bottom 705*b* on the extension line of the lower end 706 is 6 mm. That is, with respect to the longitudinal direction of the holding member 505, a distance of a gap from the boundary portion between the lower end 706 and the inclined surface 705*a* to a portion corresponding to the pressing portion 504*a* on the extension line of the lower end 706 is 13 mm.

Similarly, a distance d from a boundary portion between the inclined surface 705*a* and the bottom 705*b* to an end portion of the connector 504 on the pressing portion 504*b* side with respect to the longitudinal direction of the connector 504 is 7 mm, a distance n from a boundary portion between the lower end 706 and the inclined surface 705*c* to a portion corresponding to the boundary portion between the inclined surface 705*c* and the bottom 705*b* on the extension line of the lower end 706 is 6 mm. That is, with respect to the longitudinal direction of the holding member 505, a distance of a gap from the boundary portion between the lower end 706 and the inclined surface 705*c* to a portion corresponding to the pressing portion 504*b* on the extension line of the lower end 706 is 13 mm. Thus, in this embodiment, each of the gap between the inclined surface 705*a* and the pressing portion 504*a* and the gap between the inclined surface 705*b* and the pressing portion 504*b*, which gaps are portions where the operator places his (her) fingers for pressing the pressing portions 504*a* and 504*b* is 13 mm.

Further, as described above, the inclined surface 705*a* is inclined about 45° with respect to the lower end 706. Similarly, the inclined surface 705*b* is also inclined about 45° with respect to the lower end 706. Thus, both the inclined surfaces 705*a* and 705*b* are inclined inwardly from the lower end 706. For that reason, when the operator brings his (her) fingers near the pressing portions 504*a* and 504*b* so as to touch the pressing portions 504*a* and 504*b*, the fingers are guided to the pressing portions 504*a* and 504*b* along the inclined surfaces 705*a* and 705*b*. Thus, the inclined surfaces 705*a* and 705*b* form a device (means) for easily guiding the fingers of the operator to the pressing portions 504*a* and 504*b*.

Incidentally, these inclined surfaces 705*a* and 705*b* are not necessarily required to be provided. For example, a constitution in which the inclined surface 705*a* is not inclined with respect to the lower end 706, i.e., a constitution in which the inclination angle θ is 90° may also be employed. In the case of such a constitution, a distance from the boundary portion between the inclined surface 705*a* and the bottom 705*b* to the pressing portion 504*a* is 13 mm. This value is larger than a value in the case where the inclination angle θ is less than 90°, and therefore, a movable finger range in the gap from the boundary portion between the inclined surface 705*a* and the bottom 705*b* to the pressing portion 504*a* also becomes broad. Similarly, a constitution in which the inclined surface 705*b* is perpendicular to the lower end 706 may also be employed. In the case of such a constitution, a distance from the boundary portion between the inclined surface 705*c* and the bottom 705*b* to the pressing portion 504*b* is 13 mm. This value is larger than a value in the case where the inclination angle θ is less than 90°, and therefore, a movable finger range in the gap from the boundary portion between the inclined surface 705*a* and the bottom 705*b* to the pressing portion 504*b* also becomes broad.

Further, the connector 504 in this embodiment includes the pressing portions 504*a* and 504*b* but a connector 504 including no pressing portions 504*a* and 504*b* may also be used. The form of the locking mechanism provided in the connector 504 for maintaining the connection state with the FFC 160 is not limited to the above-described form. For example, the connector 504 may also be provided with a cover rotatable relative to a main body of the connector 504 in a direction (short side direction of the connector 504) perpendicular to both the longitudinal direction and the vertical direction of the connector 504, in place of the pressing portions 504*a* and 504*b*. The operator places this cover in an open state relative to the main body of the connector 504 when the operator connects the FFC 160 to the connector 504. The operator inserts the FFC 160 into between the opened cover and the main body of the connector 504 and then closes the cover. As a result, the FFC 160 is sandwiched between the cover and the main body of the connector 504, so that the connection state of the FFC 160 to the connector 504 is maintained. Also as regards the connector 504 having such a constitution, the cut-away portion 705 is formed on the holding member 505, whereby the operator can easily touch both sides of the connector 504 with respect to the short side direction of the connector 504.

(Moving Mechanism)

Next, necessity to move the optical print head 105 in the up-down direction and a structure of the optical print head 105 will be specifically described. FIG. 6 is a schematic view of the exposure unit 500 as seen from a right side. As described above, as regards the image forming apparatus 1 of this embodiment, the drum unit 518 can be exchanged. The exchange of the photosensitive drum 103 is carried out by dismounting the drum unit 518, to be exchanged, from the apparatus main assembly by moving the device 518 toward a front side of the photosensitive drum 103 with respect to the rotational axis direction of the photosensitive drum 103. When the drum unit 518 is moved in a state in which the optical print head 105 is positioned in the neighborhood of the surface of the photosensitive drum 103, for example, the surface of the photosensitive drum 103 and the lens array 506 are in contact with each other, so that there is a liability that the surface of the photosensitive drum 103 is damaged. Further, there is also a liability that the lens array 506 contacts the frame or the like of the drum unit 518 and thus is damaged. For that reason, during the exchange of the drum unit 518, there is a need that the optical print head 105 is spaced from the drum unit 518 so that the drum unit 518 and the optical print head 105 are not in contact with each other. On the other hand, during image formation, there is a need that the optical print head 105 is positioned to the photosensitive drum 103 with accuracy. For that reason, there is a need to provide a mechanism (moving mechanism 640) for reciprocating the optical print head 105 between an exposure position where the optical print head 105 contacts the drum unit 518 and is positioned to the photosensitive drum 103 for exposing the photosensitive drum 103 to light with the LEDs 503 (this exposure position is also referred to as a contact position: part (a) of FIG. 6) and an exchanging position where the optical print head 105 is spaced from the drum unit 518 and positioning of the optical print head 105 is eliminated for exchanging the drum unit 518 (this exchanging position is also referred to as a spaced position: part (b) of FIG. 6). When the slidable portion 525 is moved in an arrow A direction in a state in which the optical print head 105 is in the exposure position (part (a) of FIG. 6), the optical print head 105 is moved toward the exchanging position (part (b) of FIG. 6). On the other hand, when the slidable portion 525 is moved in an arrow B direction in a state in which the optical print head 105 is in the exchanging position (part (b) of FIG. 6), the optical print head 105 is moved toward the exposure position (part (a) of FIG. 6).

In the following, a movement direction of the optical print head 105 from the exchanging position toward the exposure position by the moving mechanism 640 and a movement direction of the optical print head 105 from the exposure position toward the exchanging position by the moving mechanism 640 are referred to as a "reciprocation direction" in which the optical print head 105 is reciprocated.

In the following, a structure of the moving mechanism 640 will be described specifically. Part (a) of FIG. 7 is a schematic perspective view of the moving mechanism 640 when a front side of the moving mechanism 640 is seen from a left side, and part (b) of FIG. 7 is a schematic perspective view of the moving mechanism 640 when a rear side of the moving mechanism 640 is seen from a right side. The moving mechanism 640 includes the first link mechanism 861, the slidable portion 525 and a third supporting portion (supporting member) 526. The third supporting portion 526 is an elongated metal plate and includes a supporting shaft 531 and an E-shaped stopper ring 533. The supporting shaft 531 is inserted through openings provided in surfaces (left side surface and right side surface) which opposes with respect to the left-right direction of the third supporting portion 526. Further, the supporting shaft 531 is retained by the E-shaped stopper ring 533 on an outside of the left side surface so as not to be disconnected through the opening of the third supporting portion 526. As a result, the supporting shaft 531 is fixed in a state in which the supporting shaft 531 connects the left side surface and the right side surface of the third supporting portion 526.

The slidable portion 525 is provided with an elongated hole 691 extending in the front-rear direction. The supporting shaft 531 is inserted into the elongated hole 691 and is loosely engaged in the elongated hole 691 with a gap of, e.g., about 0.1-0.5 mm with respect to the up-down direction. For that reason, the slidable portion 525 is slidable (movable) relative to the third supporting portion 526 in a distance corresponding to a length of the elongated hole 691 with respect to the front-rear direction in a state in which movement of the slidable portion 525 relative to the third supporting portion 526 with respect to the up-down direction is prevented.

The first link mechanism 861 includes the link member 651 and the link member 653. A length of the link member 653 with respect to the longitudinal direction is shorter than a length of the link member 651 with respect to the longitudinal direction, and the link members 651 and 653 constitute a link member of a λ type.

The first link mechanism 861 will be described using FIGS. 7 and 8. Part (a) of FIG. 8 is a schematic view of a cross-section of the first link mechanism 861 cut along the rotational axis direction in the left-right direction as seen from the right side. Each of the link members 651 and 653 is a single link member, but may also be constituted by combining a plurality of link members.

The link member 651 includes a bearing portion 610, a projection 655 and a connecting shaft portion 538. The bearing portion 610 is a cylindrical project provided with a hollow hole and stands toward the right side on one end side of the link member 651 with respect to the longitudinal direction. The projection 655 is a cylindrical projection standing in the rotational axis direction of the link member 651 on the other end side of the link member 651 with respect to the longitudinal direction. This projection is mounted to the holding member 505 of the optical print head 105. The connecting shaft portion 538 is provided between the bearing portion 610 and the projection 655 with respect to the longitudinal direction of the link member 651.

The slidable portion 525 is provided with an engaging shaft portion 534. The engaging shaft portion 534 is a cylindrical projection standing from the slidable portion 525 in the left direction. The engaging shaft portion 534 forms a first connecting portion by being engaged rotatably in a hole of the bearing portion 610. That is, the link member 651 is rotatable about the first connecting portion relative to the slidable portion 525. Incidentally, in this embodiment, a constitution in which the engaging shaft portion 534 is formed on the link member 651 side and in which the bearing portion 610 is formed on the slidable portion 525 side may also be employed.

The link member 653 includes a connecting shaft portion 530. The connecting shaft portion 530 is provided on one end side of the link member 653 with respect to the longitudinal direction of the link member 653. The connecting shaft portion 530 is a cylindrical project standing from the link member 653 toward the left side. The connecting shaft portion 530 is engaged rotatably in a hole formed in the third supporting portion 526 and forms a second connecting portion. In this embodiment, the connecting shaft portion 530 may also be formed on the third supporting portion 526, not the link member 653. That is, in the hole provided in the link member 653, the connecting shaft portion 530 formed on the third supporting portion 526 may also be engaged.

The link member 653 is provided with a circular hole formed on the other end side thereof with respect to the longitudinal direction. In the hole, the connecting shaft portion 538 of the link member 651 is rotatably engaged, so that the connecting shaft portion 538 and the hole of the link member 653 form a fourth connecting portion. That is, the link member 653 is rotatable about the third connecting portion relative to the third supporting portion 526 and is rotatable about the fourth connecting portion relative to the link member 651. In this embodiment, the connecting shaft portion 538 may also be formed on the link member 653, not the link member 651. That is, the connecting shaft portion 538 formed on the link member 653 may also be rotatably engaged in a hole formed in the link member 651.

A structure of the second link mechanism 862 is also similar to the above-described structure of the first link mechanism 861. The link members 652 and 654 of the second link mechanism 862 correspond to the link members 651 and 653, respectively, of the first link mechanism 861. Correspondingly to the first connecting portion, connecting portion between one end side portion of the link member 652 with respect to the longitudinal direction and the slidable portion 525 constitutes a second connecting portion. Incidentally, in the moving mechanism 640, either one of the link members 653 and 654 may also be omitted.

By the above constitution, when the slidable portion 525 is slid from the front side toward the rear side relative to the third supporting portion 526, the bearing portion 610 engaged with the engaging shaft portion 534 is slid together with the slidable portion 525 from the front side toward the rear side relative to the third supporting portion 526. As a result, when the first link mechanism 861 is seen from the rear side, the first link mechanism 861 is rotated about the engaging shaft portion 534 in the clockwise direction, and the link member 653 is rotated about the connecting shaft portion 530 in the counterclockwise direction. Therefore, the projection 655 is moved from the exposure position toward the exchanging position.

On the other hand, when the slidable portion 525 is slid (moved) from the rear side toward the front side relative to the third supporting portion 526, the link members 651 and 653 are moved in a direction opposite to the arrow direction shown in part (a) of FIG. 8.

When the slidable portion 525 is slid from the rear side toward the front side relative to the third supporting portion 526, the bearing portion 610 engaged with the engaging shaft portion 534 is slid together with the slidable portion 525 from the rear side toward the front side relative to the third supporting portion 526. As a result, as shown in part (a) of FIG. 8, when the first link mechanism 861 is seen from the rear side, the first link mechanism 861 is rotated about the engaging shaft portion 534 in the counterclockwise direction, and the link member 653 is rotated about the connecting shaft portion 530 in the clockwise direction. Therefore, the projection 655 is moved from the exchanging position toward the exposure position.

Here, (1) a distance between a rotation center axis of the connecting shaft portion 538 and a rotation center axis of the beating portion 610 is L1, (2) a distance between the rotation center axis of the connecting shaft portion 538 and a rotation center axis of the connecting shaft portion 530 is L2, and (3) a distance between the rotation center axis of the connecting shaft portion 538 and a rotation center axis of the projection 655 is L3. In the moving mechanism 640, the first link member 641 forms Scott-Russel's mechanism in which L1, L2 and L3 are equal to each other (part (b) of FIG. 8), so that the projection 655 is vertically moved (along a broken line A in part (b) of FIG. 8) with respect to a slide (movement) direction of the engaging shaft portion 534, and therefore, in the above-described link mechanism, the optical print head 105 can be moved substantially in an optical axis direction of the lens.

Incidentally, in this embodiment, a structure in which a combination of the link member 651 (652) and the link member 653 (654) in the first link mechanism 861 (second link mechanism 862) is reversed with respect to the front-rear direction, i.e., a structure in which a full length of the link member 651 (652) is shorter than a full length of the link member 653 (654) and in which the link member 651 (652) is mounted between one end side and the other end side of the link member 653 (654) may also be used. In this case, when the slidable portion 525 is slid from the front side toward the rear side, the optical print head 105 is moved from the exchanging position toward the exposure position, and when the slidable portion 525 is slid from the rear side toward the front side, the optical print head 105 is moved from the exposure position toward the exchanging position. The cover 558 described later is connected with the slidable portion 525 and has a structure such that the slidable portion 525 is moved from the front side toward the rear side in interrelation with movement of the cover 558 from an open state toward a closed state and is moved from the rear side toward the front side in interrelation with movement of the cover 558 from the closed state toward the open state.

Further, the mechanism for moving the optical print head 105 is not limited to the moving mechanism 640 but may also be a moving mechanism 940 shown in FIG. 9. In the following, the moving mechanism 940 will be described using FIG. 9. Incidentally, members having functions substantially similar to the members constituting the moving mechanism 640 are described by adding thereto the same reference numerals or symbols and will be omitted from redundant description in some cases.

As shown in FIG. 9, a first cam portion 112 and a second cam portion 113 are provided on the front side and the rear side, respectively, of the slidable portion 525. Further, at a lower portion of a holding member 905 on the front side, a movement supporting portion 114 is provided, and at a lower portion of the holding member 905 on the rear side, a movement supporting portion 115 is provided. Each of the first and second cam portions 112 and 113 has an inclined surface descending from the rear side toward the front side.

Part (a) of FIG. 9 is a schematic view of the optical print head 105 located in the exposure position and the moving mechanism 940 as seen from the rear side. In the case where the optical print head 105 is in the exposure position, when the slidable portion 525 is slid from the front side toward the rear side relative to the third supporting portion 526, the first and second cam portions 112 and 113 are moved together with the slidable portion 525 from the front side toward the rear side relative to the third supporting portion 526. As a result, lower ends of the movement supporting members 114 and 115 provided on the holding member 905 are moved from the exposure position toward the exchanging position along the first and second cam portions 112 and 113, respectively.

Part (b) of FIG. 9 is a schematic view of the optical print head 105 located in the exchanging position and the moving mechanism 940 as seen from the rear side. In the case where the optical print head 105 is in the exchanging position, when the slidable portion 525 is slid from the rear side toward the front side relative to the third supporting portion 526, the first and second cam portions 112 and 113 are moved together with the slidable portion 525 from the rear side toward the front side relative to the third supporting portion 526. As a result, lower ends of the movement supporting members 114 and 115 provided on the holding member 905 are moved from the exchanging position toward the exposure position by being pushed upward by the first and second cam portions 112 and 113, respectively.

Here, the inclined surface of each of the first and second cam portions 112 and 113 may also descend from the front side toward the rear side. In this case, when the slidable portion 525 is slid from the front side toward the rear side, the optical print head 105 is moved from the exchanging position toward the exposure position, and when the slidable portion 525 is slid from the rear side toward the front side, the optical print head 105 is moved from the exposure position toward the exchanging position. The cover 558 described later has a structure such that the cover 558 is connected with the slidable portion 525 through a link mechanism, for example and the slidable portion 525 is moved from the front side toward the rear side in interrelation with movement of the cover 558 from the open state toward the closed state and is moved from the rear side toward the front side in interrelation with movement of the cover 558 from the closed state to the open state.

Incidentally, in this embodiment, the mechanism in which in response to the slide (movement) of the slidable portion 525, the optical print head 105 is moved between the exposure position and the exchanging position spaced from the photosensitive drum 103 than the exposure position is was described, but is not limited thereto. For example, an elastic member such as a spring for connecting the third supporting portion 526 and the holding member 505 so that the optical print head 105 is moved vertically relative to the third supporting portion 526 in response to mounting and dismounting of the drum unit 518 relative to the apparatus main assembly without providing the slidable portion 525, the link mechanisms (861, 862) and the cam mechanisms (112, 113) may also be provided. In the case of such a mechanism, when the drum unit 518 is mounted from the outside of apparatus main assembly, the optical print head 105 contacting the drum unit 518 is pushed down toward the third supporting portion 526 while urging the spring, so that the optical print head 105 is placed in the exposure position.

Part (a) of FIG. 10 is a schematic perspective view for illustrating a structural feature of an opening portion 161 provided in the third supporting portion 526. Further, part (b) of FIG. 10 is a sectional view of a portion, where the opening portion 161 of the third supporting portion 526 is provided, cut along a plane perpendicular to a rotational axis of the photosensitive drum 103. As shown in part (a) of FIG. 10, the third supporting portion 526 is formed with a channel-shaped metal plate provided with a recessed portion on an upper side thereof. Further, the opening portion 161 which is a hole penetrating through the third supporting portion 526 in the up-down direction is provided between one end side and the other end side of the third supporting portion 526. Above the opening portion 161, the connector 504 provided on the back side of the substrate 502 is positioned. The FFC 160 passes through the opening portion 161 and is connected at one end thereof with the connector 504 and is connected at the other end thereof with a connector (not shown) of the main assembly substrate provided in the apparatus main assembly. Here, in this embodiment, a constitution in which the opening portion 161 is provided at a bottom (surface) of the third supporting portion 526 will be described, but the opening portion 161 may also be provided at a side surface of the channel-shaped third supporting portion 526 and may also be provided from the side surface (side portion) to the bottom (bottom portion). Further, the shape of the third supporting portion 526 itself is not required to be the channel shape, but the third supporting portion 526 may also be formed with an L-shaped metal plate. Further, in this embodiment, the FFC 160 is mounted on the substrate 502 so that a broad surface thereof faces the left-right direction, but may also be mounted on the substrate 502 so that the broad surface thereof faces the front-rear direction.

A positional relationship between the slidable portion 525 and the FFC 160 will be described using part (a) of FIG. 10. As shown in part (a) of FIG. 10, the slidable portion 525 is disposed so as to overlap with a part of the FFC 160 with respect to a perpendicular direction perpendicular to both the rotational axis direction of the photosensitive drum and the reciprocation direction in which the optical print head 105 is reciprocated by the moving mechanism 640. Further, as shown in parts (a) and (b) of FIG. 10, between the slidable portion 525 and the FFC 160, a part of a protective member 162 which is provided to the third supporting portion 526 and which is described later is positioned. As a result, the slidable portion 525 and the flexible flat cable 160 are prevented from contacting each other.

Here, a processing method of a metal member such as the third supporting portion 526 will be described. In general, as a method of metal working, shearing has been known. Incidentally, the shearing referred to herein means shearing in a broad sense and refers to a processing method in which a metal plate is plastically deformed (shearing-deformed) using a tool and thus the material (metal plate) is broken and cut into a desired shape and a desired dimension and which includes blanking carried out using a press machine and a press metal mold. In such shearing, a burr generates at a cutting plane (cutting surface) of a material-to-be-processed. A direction of the burr generating at the cutting plane coincides with a direction of the blanking of the material-to-be-processed. In the case where the opening portion 161 is provided in the third supporting portion 526 by the shearing, the burr generates also at a cutting plane (cutting surface) 163 (portions enclosed by broken lines in part (b) of FIG. 10). In this embodiment, the burr is formed from the cutting plane 163 toward an inside of the third supporting portion 526. Therefore, there is a need to devise a method (means) to protect the FFC 160 passing through the opening portion 161 from the burr generated at the cutting plane 163. It is also possible to remove the formed burr to some extent by chamfering or the like after the shearing, but even at the cutting plane 163 subjected to the chamfering, it is undesirable that the FFC 160 slides with the cutting plane 163 of the metal plate. It is difficult to say that the constitution is an optimum constitution from the view point of realizing lifetime extension of the FFC 160.

Therefore, as shown in part (b) of FIG. 10, provision of the third supporting portion 526 with the protective member 162 (an example of a molded product prepared by integrally molding a first cover portion and a second cover portion) formed so as to cover the cutting plane 163 will be considered. The protective member 162 includes an opposing surface 162*a* (an example of the first cover portion) opposing one surface (front surface) of the FFC 160 and an opposing surface 162*b* (an example of the second cover portion) opposing the other surface (back surface) of the FFC 160. In this embodiment, the protective member 162 is made of a resin material, but may also be made of a rubber material or a silicone-based material. The optical print head 105 shown in parts (a) and (b) of FIG. 10 is in a state in which the optical print head 105 is in the exposure position. That is, compared with the case where the optical print head 105 is in the exchanging position, a distance of the optical print head 105 from the third supporting portion 526 is large. For that reason, as shown in part (b) of FIG. 10, the FFC 160 is in a stretched state in the up-down direction. However, when the optical print head 105 is moved to the exchanging position, the FFC 160 is loosened. When the FFC 160 is loosened, the FFC 160 contacts the protective member 162, but the protective member 162 to which the FFC 160 is contacted is made of the resin material, and therefore, the FFC 160 is not damaged. If the cutting plane 163 is not covered with the protective member 162, the FFC 160 and the cutting plane 163 are contacted to each other every time when the optical print head 105 is moved by the moving mechanism 640. As in this embodiment, for example, the cutting plane 163 is covered with the protective member 162 made of the resin material and thus the FFC 160 and the cutting plane 163 are made in non-contact with each other, so that lifetime extension of the FFC 160 can be expected. Incidentally, a structure in which the protective member 162 and the FFC 160 are always in contact with each other may also be used.

In a mounting structure between the FFC 160 and the substrate 502 shown in FIG. 10, the widthwise direction of the FFC 160 coincides with the FR-rear direction, and a thickness direction of the FFC 160 coincides with the left-right direction, and therefore, when the optical print head 105 is moved to the exchanging position, the FFC 160 is folded with respect to the left-right direction. Accordingly, assuming that there is no protective member 162, a possibility that broad surfaces (on both sides with respect to the left-right direction) of the FFC 160 contact the cutting plane 163 is high. For that reason, with respect to the cutting plane 163 of the opening portion 161, the protective member 162 may preferably be provided at an overlapping position with the flexible flat cable with respect to a direction perpendicular to both the rotational axis direction (front-rear direction) of the photosensitive drum 103 and the direction (reciprocation direction: direction in which the optical print head 105 moves between the exposure position and the exchanging position) in which the optical print head 105 is reciprocated by the moving mechanism 640. That is, the protective member 162 may desirably be provided over an entire area of the cutting plane 163, but when the protective member 162 is provided at a position opposing the front and back surfaces of the FFC 160, it sufficiently suppresses the damage of the FFC 160 caused by contact of the FFC 160 with the cutting plane 163. When contact between the FFC 160 and the cutting plane 163 can be prevented, the protective member 162 may also be provided to the second supporting portion 526 so as to cover only a part of the cutting plane 163.

Further, as shown in part (b) of FIG. 10, the protective member 162 extends to a position (toward the substrate 502) above the slidable portion 525. This is because the FFC 160 is prevented from contacting the slidable portion 525 slidable relative to the third supporting portion 526 and from being damaged by the slidable portion 525. Here, from the viewpoint of ensuring strength of the slidable portion 525, the slidable portion 525 may desirably be formed with a channel-shaped metal plate as shown in parts (a) and (b) of FIG. 10, but may also be formed with an L-shaped metal plate.

Further, as shown in part (a) of FIG. 10, in an overlapping region of the slidable portion 525 with the protective member 162 with respect to the left-right direction, the slidable portion 525 is provided with a cut-away portion formed at an upper portion of the slidable portion 525. This is a structure for preventing the slidable portion 525 from contacting the protective member 162.

FIG. 11 is a perspective view of the opening portion 161 provided in the third supporting portion 526 as seen from a side below the opening portion 161. As shown in FIG. 11, the protective member 162 is a separate member from the third supporting portion 526, and has a structure capable of being mounted on and dismounted from the third supporting portion 526 through the opening portion 161 by a snap-fitting mechanism, for example. The snap-fitting mechanism referred to herein means a mechanism which is used for fixing two members by engaging the two members with the opening portion 161 by using elasticity of the material and which is a fastening mechanism of component parts with no screw.

Part (a) of FIG. 12 is a schematic perspective view of a first supporting portion 527 to which a front side portion of the third supporting portion 526 is to be mounted. The first supporting portion 527 includes a first bearing surface 586, a wall portion 127, a projection 601, a screw hole 602, positioning bosses 603 and 604, a screw hole 605 and a contact surface 681.

The first bearing surface 586 is a portion where a front side lower end of the holding member 505 moved from the exposure position toward the exchanging position contacts the first bearing surface 586 from above with respect to the vertical direction. The holding member 505 contacts the first bearing surface 586, so that the optical print head 105 is placed in the exchanging position.

The first supporting portion 527 is fixed to the front side plate 642. The front side plate 642 is provided with the positioning bosses 603 and 604 and a plurality of holes (not shown) corresponding to fixing bosses, respectively. The positioning bosses 603 and 604 are inserted in the holes provided in the front side plate 642. In that state, the first supporting portion 527 and the front side plate 642 are fixed with each other with screws passed through the screw holes 602 of the first supporting portion 527.

The wall portion 127 stands from the first supporting portion 527 toward the rear side so as to sandwich, with respect to the left-right direction, the first contact member 514 projecting from the lower side of the holding member 505. The wall portion 127 is provided at positions opposing left and rear side portions of the first contact member 514, so that movement of the first contact member 514 in the left-right direction is prevented. As a result, the front side portion of the holding member 505 to which the first contact member 514 is fixed is also prevented from moving in the left-right direction.

Part (b) of FIG. 12 is a schematic view for illustrating a state in which the front side portion of the third supporting portion 526 is inserted into a portion enclosed by a broken line shown in part (a) of FIG. 12. Part (c) of FIG. 12 is a schematic view showing a state in which the front side portion of the third supporting portion 526 is inserted in the portion enclosed by the broken line shown in part (a) of FIG. 12. As shown in parts (b) and (c) of FIG. 12, the third supporting portion 526 is a metal plate bent in a channel shape. As a material of the metal plate, for example, aluminum is used. The third supporting portion 526 is provided with a cut-away portion on the front side thereof. The cut-away portion and the projection 601 of the first supporting portion 527 engage with each other, so that the position of the third supporting portion 526 relative to the first supporting portion 527 with respect to the left-right direction is determined. The third supporting portion 526 is fixed to the first supporting portion 527 by a screw inserted through the screw hole 602 in a state in which the third supporting portion 526 contacts the contact surface 681.

Part (a) of FIG. 13 is a schematic perspective view of a second supporting portion 528 to which a rear side portion of the third supporting portion 526 is to be mounted. The second supporting portion 528 includes a second bearing surface 587 and a wall portion 128.

The second bearing surface 587 has the same function as the above-described first bearing surface 586. To the second bearing surface 587, a rear side lower end of the holding member 505 moved from the exposure position toward the exchanging position is contacted. That is, the holding member 505 of the optical print head 105 located in the exchanging position is supported by the first bearing surface 586 and the second bearing surface 587.

The wall portion 128 stands from the second supporting portion 528 toward the front side so as to sandwich, with respect to the left-right direction, the second contact member 515 projecting from the lower side of the holding member 505. The wall portion 128 is provided at positions opposing left and rear side portions of the second contact member 515, so that movement of the second contact member 515 in the left-right direction is prevented. As a result, the rear side portion of the holding member 505 to which the second contact member 515 is fixed is also prevented from moving in the left-right direction. The wall portion 127 described above prevents the movement of the first contact member 514 in the left-right direction, and the wall portion 128 prevents the movement of the second contact member 515 in the left-right direction, so that the holding member 505 is prevented from moving in the left-right direction over the longitudinal direction thereof. That is, it is possible to reduce a degree of a liability that the optical print head 105 moves in the left-right direction during movement from the exchanging position toward the exposure position. In order to obtain this effect, the wall portions 127 and 128 may preferably be formed on the first supporting portion 527 and the second supporting portion 528, respectively, but the wall portion may also be formed on either one of the first and second supporting portions 527 and 528.

As shown in part (b) of FIG. 13, the second supporting portion 528 is fixed to the front side surface of the rear side plate 643. The second supporting portion 528 is fixed to the rear side plate 643 by a positioning boss and a screw. The exposure unit 500 is inserted in an arrow direction shown in part (b) of FIG. 13 through an opening formed in the front side plate 642, so that the third supporting portion 526 is fixed to the second supporting portion 528.

Part (c) of FIG. 13 shows a state in which the rear side portion of the third supporting portion 528 is inserted in a portion enclosed by a broken line shown in part (a) of FIG. 13. The third supporting portion 526 is supported by the first supporting portion 527 on the front side and is supported by the second supporting portion 528 on the rear side. That is, both the first supporting portion 527 and the third supporting portion 528 are fixed to the image forming apparatus 1 main assembly. Therefore, the third supporting portion 526 is fixed to the image forming apparatus 1 main assembly on one end side (front side) and the other end side (rear side) thereof with respect to the longitudinal direction and thus is not moved.

Incidentally, a constitution in which the second supporting portion 528 and the rear side plate 643 are not fastened with a screw may also be employed. In this case, for example, the second supporting portion 528 is provided with a recessed portion, and this recessed portion is engaged with a projected portion formed on the rear side plate 643, so that a structure in which a position of the second supporting portion 528 relative to the rear side plate 643 is determined is formed.

(Cartridge Cover)

Next, the cover 558 will be described using FIG. 14.

Part (a) of FIG. 14 is a perspective view of the cover 558 mounted to the moving mechanism 640 as seen from the right side, part (b) of FIG. 14 is a perspective view of the cover 558 mounted to the moving mechanism 640 as seen from the left side, part (c) of FIG. 14 is a perspective view for illustrating the front side plate 642 to which the cover 558 is mounted, and part (d) of FIG. 14 is a perspective view of the front side plate 642, in which the cover 558 is not shown. The operator such as a user or service person can dismount the drum unit 518 from the apparatus main assembly by placing the cover 558 in an open state (part (c) of FIG. 14). The closed cover 558 is positioned on an insertion and extraction path of the drum unit 518 and the developing unit 641. For that reason, when the cover 558 is in a closed state, the operator cannot perform an exchanging operation of the drum unit 518 and the developing unit 641. The operator can exchange the drum unit 518 by opening the cover 558 and closing the cover 558 after an end of the operation.

As shown in parts (a) and (b) of FIG. 14, the cover 558 includes rotation shaft portions 559 and 560 and a pressing portion 561. The rotation shaft portion 559 is a circular column-shaped projection projecting toward the right side of the cover 558. On the other hand, the rotation shaft portion 560 is a circular column-shaped projection projecting toward the left side of the cover 558. Incidentally, a rotational axis 563 is a rotation center axis of the cover 558 rotatable about the rotation shaft portions 559 and 560.

As shown in part (b) of FIG. 14, the pressing portion 561 is positioned in a space provided on the front side of the slidable portion 525 in a state in which the cover 558 is mounted to the front side plate 642. When the cover 558 is rotated about the rotation axis 563, the pressing portion 561 moves the slidable portion 525 in the front-rear direction in interrelation with the rotation. Specifically, when the operator rotates the cover 558 from the closed state toward the open state, the pressing portion 561 moves the slidable portion 525 from the front side toward the rear side. In interrelation with this movement of the slidable portion 525 from the front side toward the rear side, the optical print head 105 moves from the exposure position toward the exchanging position. That is, when the operator opens the cover 558, the optical print head 105 moves toward the exchanging position, so that the gap between the photosensitive drum 103 and the optical print head 105 increases. As a result, the operator can perform the exchanging operation of the drum unit 518 without contacting the drum unit 518 to the optical print head 105. On the other hand, when the operator rotates the cover 558 from the open state toward the closed state, the pressing portion 561 moves the slidable portion 525 from the rear side toward the front side. In interrelation with this movement of the slidable portion 525 from the rear side toward the front side, the optical print head 105 moves from the exchanging position toward the exposure position.

A constitution for sliding (moving) the slidable portion 525 is not limited to the cover 558. For example, a constitution in which the slidable portion 525 is slid in interrelation with opening and closing of an unshown front door may also be employed. Further, a constitution in which the slidable portion 525 is slid in interrelation with rotation of a rotatable member such as a lever, not a covering member such as the cover 558 or a door may also be employed.

As shown in parts (c) and (d) of FIG. 14, the front side plate 642 includes a bearing member 621 engageable with the rotation shaft portion 559 of the cover 558 and includes a bearing member 622 engageable with the rotation shaft portion 560 of the cover 558. Further, as shown in part (c) of FIG. 14, the rotation shaft portion 559 of the cover 558 rotatably engages with the bearing member 621 of the front side plate 642, and the rotation shaft portion 560 of the cover 558 rotatably engages with the bearing member 622 of the front side plate 642.

Embodiment 2

In Embodiment 1, a constitution in which the cutting plane 163 is covered with the protective member 162 made of the resin material in order to suppress damage of the FFC 160 by contact between the FFC 160 and the cutting plane 163 of the opening portion 161 was described. In this embodiment, a constitution in which the cutting plane 163 is covered with a protective member 164 (including a first cover portion 164*a* and a second cover portion 164*b*) having a curved surface will be described. Incidentally, for describing Embodiment 2, constituent elements other than the protective member 164 are similar to those in Embodiment 1, and therefore, the same constituent elements will be omitted from detailed description by adding thereto the same reference numerals or symbols.

As shown in part (a) of FIG. 15, the protective member 164 has a curved surface 164*a* opposing one surface (front surface) of the FFC 160 and a curved surface 164*b* opposing the other surface (back surface) of the FFC 160. The third supporting portion 526 is provided with the protective member 164 so that these curved surfaces 164*a* and 164*b* oppose broad surfaces of the FFC 160. As a result, the broad surfaces of the FFC 160 are prevented from contacting the cutting plane 163.

The protective member 162 was made of the resin material, but the protective member 164 may be made of metal (metal material). However, if the protective member 164 is made of metal and subjected to shearing, a burr generates at an end portion of the protective member 164. Even in the case where contact between the FFC 160 and the cutting plane 163 can be prevented, when the FFC 160 contacts the burr formed at the end portion of the protective member 164, the FFC 160 is damaged. For that reason, as shown in part (a) of FIG. 15, the protective member 164 is subjected to bending so that the curved surfaces are positioned closer to the FFC 160 than the burrs at the end portions of the protective member 164 are. As a result, even in the case where the optical print head 105 is moved to the exchanging position and the FFC 160 is loosened and is contacted to the protective member 164, the FFC 160 does not contact regions other than the curved surfaces.

Further, the third supporting portion 526 is provided with the first cover portion 164*a* so that a part of the first cover portion 164*a* is positioned also between the slidable portion 525 and the FFC 160, so that contact between the slidable portion 525 and the FFC 160 can be prevented.

Embodiment 3

In Embodiment 3, as shown in part (b) of FIG. 14, a constitution in which an edge portion 173 of the opening portion 161 is provided with a protective member 168 (including a first cover portion 168*a* and a second cover portion 168*b*) so as to project toward the FFC 160 will be described. Incidentally, for describing Embodiment 3, constituent elements other than the protective member 168 are similar to those in Embodiment 1, and therefore, the same constituent elements will be omitted from detailed description by adding thereto the same reference numerals or symbols. Incidentally, in this embodiment, the edge portion 173 refers to a region of not less than 10 mm from the cutting plane 163 of the opening portion 161.

As shown in part (b) of FIG. 15, the protective member 168 has an abutting portion 168*a* projected toward one surface (front surface) of the FFC 160 and an abutting portion 168*b* projected toward the other surface (back surface) of the FFC 160. The protective member 168 is provided at the edge portion 173 of the opening portion 161, so that even in the case where the FFC 160 is loosened, the FFC 160 contacts a free end of the protective member 168, whereby a gap is formed between the FFC 160 and the cutting plane 163 and thus the FFC 160 does not contact the cutting plane 163. The protective member 168 is, for example, a member made of a resin material, and a free end thereof is smoothly processed so as to have a curved surface shape. As a result, the FFC 160 is not damaged even in the case of contact with the protective member 168. The protective member 168 may be fixed to the third supporting portion 526 with a screw or an adhesive.

Embodiment 4

In Embodiment 4, as shown in part (c) of FIG. 15, a constitution in which contact between the FFC 160 and a cutting plane 166 is prevented by formation of a bent surface 167 by subjecting an edge of an opening portion 165 to bending will be described. Incidentally, for describing Embodiment 4, constituent elements other than the opening portion 165, the cutting plane 166 and the bent surface 167 are similar to those in Embodiment 1, and therefore, the same constituent elements will be omitted from detailed description by adding thereto the same reference numerals or symbols.

A feature of Embodiment 4 is that the edge of the opening portion 165 is subjected to bending so that the bent surface 167 is closer to a broad surface of the FFC 160 than the cutting plane 166 is. The bent surface 167 has an opposing surface 167*a* opposing one surface (front surface) of the FFC 160 and an opposing surface 167*b* opposing the other surface (back surface) of the FFC 160. As an example of a structure for realizing this constitution, as shown in part (c) of FIG. 15, there is a structure in which the edge of the opening portion 165 is subjected to bending so that the cutting plane 166 faces a direction of being spaced from the FFC 160. By employing such a structure, the FFC 160 and the cutting plane 166 are prevented from contacting each other. In Embodiment 4, a member corresponding to the protective member (162, 164, 168) described in Embodiments 1 to 3 is not provided. The loosened FFC 160 contacts the third supporting portion 526 made of metal, but the contact portion is a region where the third supporting portion 526 is subjected to bending, and therefore, is smooth compared with the cutting plane 166. For that reason, a degree of friction generating on the FFC 160 contacting the third supporting portion 526 is small compared with that in the case where the FFC 160 contacts the cutting plane 166. Further, the FFC 160 is prevented from contacting a burr.

Embodiment 5

In Embodiment 5, a constitution in which the FFC 160 is protected from the cutting plane 163 by providing the FFC 160 with a protective member 169 will be considered.

Part (a) of FIG. 16 is a schematic view for illustrating a positional relationship between the protective member 169 and the cutting plane 163 in the case where the optical print head 105 is in the exposure position. On the other hand, part (b) of FIG. 16 is a schematic view for illustrating a positional relationship between the protective member 169 and the cutting plane 163 in the case where the optical print head 105 is in the exchanging position.

As shown in FIG. 16, regions where the FFC 160 is provided with the protective member 169 are, for example, regions (opposing regions) of broad surfaces in which the FFC 160 moving together with the optical print head 105 moved by the moving mechanism 640 is capable of opposing the cutting plane 163. These opposing regions are covered with the protective member 169 made of a resin material, so that even in the case where the optical print head 105 is in the exposure position and in the exchanging position, the protective member 169 opposes the cutting plane 163 and therefore the FFC 160 is prevented from contacting the cutting plane 163.

Incidentally, the protective member 169 is sufficient if the protective member 169 is provided in a part of the opposing region of the FFC 160, so that the protective member 169 is not required to be provided over an entire area of the FFC 160.

The protective member 169 is a film-shape member formed of a material such as a polyvinyl chloride resin and protects the FFC 160 from mechanical wearing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2017-208427 filed on Oct. 27, 2017, and 2018-170836 filed on Sep. 12, 2018, which are hereby incorporated by reference herein in their entirety.

What is claimed is:

1. An image forming apparatus comprising:

a photosensitive member;

an exposure head including a light emitting element configured to emit light to expose the photosensitive member;

a flexible flat cable connected to the exposure head and configured to transmit a driving signal for driving the light emitting element;

a moving mechanism configured to move the exposure head between a first position where the exposure head exposes the photosensitive member and a second position different from the first position;

a supporting portion made of metal and configured to support the moving mechanism, wherein the exposure head moves between the first and second positions by the moving mechanism and the supporting portion is provided with an opening through which the flexible flat cable, movable together with the exposure head, passes;

a first protective cover portion made of a resin material and configured to cover a first portion of a cutting plane of the opening, the first portion opposing one surface of the flexible flat cable, so as to prevent contact between the flexible flat cable and the cutting plane of the opening; and a second protective cover portion made of a resin material and configured to cover a second portion of the cutting plane of the opening portion, the second portion opposing the other surface of the flexible flat cable, so as to prevent contact between the flexible flat cable and the cutting plane of the opening.

2. The image forming apparatus according to claim 1, wherein the supporting portion is positioned on a side of the exposure head opposite to a side where the photosensitive member is positioned with respect to a moving direction of the exposure head.

3. The image forming apparatus according to claim 2, further comprising:

a substrate provided on the exposure head and provided with the light emitting element; and a connector provided on the substrate and connected to the flexible flat cable, wherein the connector and the opening oppose each other with respect to the moving direction of the exposure head.

4. The image forming apparatus according to claim 1, wherein the first protective cover portion covers an entire area of the cutting plane of the opening opposing the one surface of the flexible flat cable, and the second protective cover portion covers an entire area of the cutting plane of the opening opposing the other surface of the flexible flat cable.

5. The image forming apparatus according to claim 1, wherein the first protective cover portion and the second protective cover portion comprise an integrally molded product made of the resin material.

6. The image forming apparatus according to claim 1, further comprising a slidable portion provided so as to overlap with a part of the flexible flat cable with respect to a perpendicular direction perpendicular to both of a longitudinal direction of exposure head and a moving direction of the exposure head, wherein in interrelation with movement of the slidable portion in the longitudinal direction, the moving mechanism moves the exposure head.

7. The image forming apparatus according to claim 6, wherein at least one of the first protective cover portion and the second protective cover portion is provided in the supporting member so as to be positioned between the flexible flat cable and the slidable portion, and prevents contact between the slidable portion and the flexible flat cable, which is movable together with the exposure head.

8. The image forming apparatus according to claim 1, wherein the second position is further away from the photosensitive member than the first position.

* * * * *